US010730710B2

(12) United States Patent
Doshida et al.

(10) Patent No.: US 10,730,710 B2
(45) Date of Patent: Aug. 4, 2020

(54) SHEET FEEDER, SHEET CONVEYER HAVING THE SAME, AND IMAGE FORMING DEVICE HAVING THE SAME

(71) Applicant: KONICA MINOLTA, INC., Chiyoda-ku, Tokyo (JP)

(72) Inventors: Yuki Doshida, Toyokawa (JP); Masanobu Tomiyasu, Toyokawa (JP); Shigeru Sawano, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/922,076

(22) Filed: Mar. 15, 2018

(65) Prior Publication Data

US 2018/0265315 A1 Sep. 20, 2018

(30) Foreign Application Priority Data

Mar. 16, 2017 (JP) ..... 2017-051642

(51) Int. Cl.
*B65H 1/26* (2006.01)
*B65H 5/06* (2006.01)
(Continued)

(52) U.S. Cl.
CPC ..... *B65H 1/266* (2013.01); *B65H 1/12* (2013.01); *B65H 3/0684* (2013.01); *B65H 5/06* (2013.01);
(Continued)

(58) Field of Classification Search
CPC . B65H 1/12; B65H 1/266; B65H 9/06; B65H 9/101; B65H 2403/41;
(Continued)

(56) References Cited

U.S. PATENT DOCUMENTS 5,222,725 A * 6/1993 Kasahara ..... B65H 1/04 271/127
5,232,215 A * 8/1993 Hashimoto ..... B65H 1/04 271/126
(Continued)

FOREIGN PATENT DOCUMENTS

JP 2002265073 A 9/2002
JP 2005247522 A 9/2005
(Continued)

OTHER PUBLICATIONS

SIPO First Office Action corresponding to CN Application No. 201810202348.7; dated Apr. 2, 2019.

*Primary Examiner* — Prasad V Gokhale
(74) *Attorney, Agent, or Firm* — Cantor Colburn LLP

(57) ABSTRACT

In a paper cassette, a guide slides on a tray to place a sheet at a proper position. A lift mechanism uses a restoring force of an elastic member to push up the tray and make the sheet on the tray approach a pickup roller. When the paper cassette is pushed by a user from an opened position, which is out of the housing of a printer, to a closed position, which is in the housing, an adjuster mechanism mechanically converts a force of the user pushing the paper cassette to the restoring force of the elastic member from a time the guide reaches a specific point on a trajectory along which the guide travels together with the paper cassette, thus adjusting the strength of the restoring force continuously to a distance by which the guide overruns the specific point.

21 Claims, 7 Drawing Sheets

(51) Int. Cl.

| | |
|---|---|
| ***G03G 15/00*** | (2006.01) |
| ***B65H 3/06*** | (2006.01) |
| ***B65H 1/12*** | (2006.01) |
| ***B65H 9/10*** | (2006.01) |

(52) U.S. Cl.
CPC ..... *B65H 9/101* (2013.01); *G03G 15/6502* (2013.01); *G03G 15/6511* (2013.01); *G03G 15/6529* (2013.01); *B65H 2402/542* (2013.01); *B65H 2403/41* (2013.01); *B65H 2405/114* (2013.01); *B65H 2405/12* (2013.01); *B65H 2511/12* (2013.01); *B65H 2511/20* (2013.01); *B65H 2515/34* (2013.01)

(58) Field of Classification Search
CPC .... B65H 2405/1122; B65H 2405/1134; B65H 2405/114; B65H 2405/1144; B65H 2511/10; B65H 2511/11; B65H 2511/12
USPC ..... 271/171
See application file for complete search history.

(56) References Cited

U.S. PATENT DOCUMENTS

| | | | | |
|---|---|---|---|---|
| 5,292,116 | A * | 3/1994 | Inoue | B65H 1/04 271/157 |
| 7,147,219 | B2 * | 12/2006 | Soo | B65H 1/26 271/157 |
| 7,448,613 | B2 * | 11/2008 | Takahashi | B65H 1/12 271/157 |
| 2014/0367908 | A1 * | 12/2014 | Sawada | B65H 1/12 271/160 |
| 2016/0214809 | A1 * | 7/2016 | Waragai | B65H 1/12 |
| 2017/0275114 | A1 * | 9/2017 | Matsui | B65H 1/12 |

FOREIGN PATENT DOCUMENTS

| | | | |
|---|---|---|---|
| JP | 2006327736 | A | 12/2006 |
| JP | 2011031995 | A | 2/2011 |
| JP | 2012121685 | A | 6/2012 |

* cited by examiner

SHEET FEEDER, SHEET CONVEYER HAVING THE SAME, AND IMAGE FORMING DEVICE HAVING THE SAME

CROSS-REFERENCE TO RELATED APPLICATIONS

This application claims priority to Japanese Patent Application No. 2017-051642, filed, Mar. 16, 2017, the entire contents of which are hereby incorporated by reference in their entirety.

BACKGROUND

1. Technical Field

The invention relates to sheet feeders, and in particular, mechanism of adjusting pressure for feeding sheets.

2. Related Art

"Sheet feeder" means a device automatically feeding sheets such as documents or printing paper to a machine processing the sheets such as a printer, copier, scanner, fax machine, or finisher. Sheet feeders are in general equipped with paper cassettes and pickup or feed rollers, which are hereinafter referred to as "pickup rollers." Each paper cassette has an inner space in which sheets to be fed can be stacked. Pickup rollers rotate with their outer circumferential surfaces contact with the top of a sheaf of the sheets, thus separating each sheet from the sheaf and transmitting it to a conveyance path.

One of important mechanisms built in the sheet feeders is a mechanism of adjusting pressure for feeding sheets. See, e.g. JP 2002-265073, JP 2005-247522, JP 2006-327736, JP 2011-031995, and JP 2012-121685. Pressure for feeding sheets, which is hereinafter referred to as "sheet feed pressure," means pressure that pushes one of a sheet and a pickup roller onto the other. In order to rip the first sheet forming the top of a sheaf of sheets apart from the second sheet directly below the first sheet, a pickup roller is required to exert on the first sheet a friction force appropriately stronger than a friction force between the first and second sheets. In order to make the pickup roller generate such a friction force, sheet feed pressure needs to be maintained within a proper range. If the pressure is too low to exert a sufficient friction force onto the first sheet, the pickup roller tends to slip, and thus there is a high risk of loss of a sheet to be fed or a skewing sheet. If the pressure is too high, a friction force between the first and second sheets excessively increases directly below the pickup roller, and thus feeding multiple sheets can occur. Concrete adjuster mechanisms include, in addition to a mechanism using a force pushing down a pickup roller onto sheets, a mechanism inclining at least a portion of a tray such as the bottom plate of the paper cassette, to use a force pushing up sheets toward a pickup roller.

A mechanism of positioning a sheaf of sheets is also essential to a sheet feeder. When the leading edge of a sheet touches a pickup roller at a proper place, the sheet is fed to the conveyance path in a proper orientation. In this case, both feeding multiple sheets and sheets skewing hardly occur, and thus sheet jams are prevented. Concrete positioning mechanisms include, for example, a mechanism equipped with a plate-shaped guide on a bottom or side surface of a paper cassette. The guide is slidable on the tray manually or automatically to touch an edge of a sheet in a direction in which the sheet is to be fed, or both sides of the sheet with respect to the direction, thus positioning the edge or sides of the sheet at a proper position.

When the mechanism of adjusting sheet feed pressure is of a type of pushing up sheets, the force pushing up sheets has a strength varying with sizes of the sheets since weights of the sheets on the inclined portion of the tray vary with sizes of the sheets. Different sizes of the sheets are aligned by the guide at different positions. By using these relationships, a sheet feeder under development coordinates the mechanism pushing up sheets and the mechanism positioning sheets. See, e.g. JP 2002-265073, JP 2005-247522, JP 2006-327736, and JP 2011-031995. Coordinating both the mechanisms adjusts the force pushing up sheets according to the position of the guide, thus improving operability of sheet feeders.

SUMMARY

In recent years, image forming devices such as printers and copiers are widely spread among not only offices of typical sizes but also small offices home offices (SOHO) and standard homes. This increasingly diversifies sheet sizes to be treated by sheet feeders: not only standard sizes specified by Japanese industrial standards (JIS), i.e. A and B series, but also business cards, bookmarks, tickets, postcards, envelopes, and photographs (L size). For further increase in demand for image forming devices mainly among SOHO and standard homes, sheet feeders capable of treating a larger variety of sheet sizes are more advantageous.

On the other hand, image forming devices to be used particularly in SOHO and standard homes are required to achieve further reduced sizes and improved operability by lower costs. Meeting this request in addition to diversifying treatable sizes of sheets is difficult for known sheet feeders.

Indeed, sheet feeders disclosed in JP 2002-265073, JP 2005-247522, and JP 2006-327736 all coordinate the mechanism of pushing up sheets and the mechanism of positioning the sheets, thus achieving high operability. However, the sheet feeders can change the force pushing up sheets only stepwise according to the position of the guide, and thus can treat only limited sizes of sheets that are discretely distributed. Since these sheet feeders have source of the pushing force consisting of plural springs independent from each other, the sheet feeders can have a reduced number of springs that exert a resistive force on the guide when it slides manually, but relationship between strengths of these springs and sheet feed pressures varies widely with products, and therefore, further increase in accuracy of adjusting sheet feed pressure is never easy.

A sheet feeder disclosed in JP 2011-031995 extends with a motor a spring that is source of a force pushing up sheets, and determines the position of a sensor for detecting a stretch of the spring according to the position of the guide. A sheet feeder disclosed in JP 2012-121685 generates with a motor a force pushing up sheets, and monitors through a sensor an amount of rise in height of the sheets to control the motor. Since both the sheet feeders can continuously change the force pushing up sheets according to sizes of the sheets, the sheet feeders can treat sizes of the sheets that are continuously distributed. Since linkages between the mechanism of pushing up sheets and the mechanism of positioning the sheets are not mechanical ones operated by hand, but electrical ones operated by motors and sensors, the sheet feeders easily prevent source of the force pushing up sheets from obstructing the sliding guides. However, use of motors and sensors complicates further reduction in cost of manufacturing the sheet feeders.

An object of the invention is to solve the above-mentioned problems, and in particular, to provide a sheet feeder capable of easily adjusting the strength of a force pushing up sheets continuously to the position of a guide, regardless of a manually operated, mechanical linkage between the mechanism of pushing up sheets and the mechanism of positioning the sheets.

A sheet feeder according to one aspect of the invention includes a housing, a pickup roller, and a paper cassette. The pickup roller touches a surface of a sheet to feed the sheet out of the housing. The paper cassette is attached to the housing to be able to slide out like drawers, storing the sheet to be fed by the pickup roller. The paper cassette includes a body, a guide, a lift mechanism, and an adjuster mechanism. The body has a tray allowing the sheet to be loaded thereon. The guide can slide on the tray to touch a side of the sheet and align the sheet at a proper position. The lift mechanism has a substantially single-piece elastic member, and by a restoring force of the elastic member, pushes up at least one portion of the tray on which a portion of the sheet is aligned, to exert a force directing the portion of the sheet towards the pickup roller. When the paper cassette is pushed by a user from an opened position, which is out of the housing, to a closed position, which is in the housing, the adjuster mechanism mechanically converts a force of the user pushing the paper cassette to the restoring force of the elastic member from a time the guide reaches a specific point on a trajectory along which the guide travels together with the paper cassette, thus adjusting the strength of the restoring force continuously to a distance by which the guide overruns the specific point.

A sheet conveyer according to one aspect of the invention includes the above-mentioned sheet feeder and a conveyer conveying a sheet fed from the sheet feeder. An image forming device according to one aspect of the invention includes this sheet conveyer and a printer section printing an image on the sheet conveyed by the sheet conveyer.

BRIEF DESCRIPTION OF THE DRAWINGS

The advantages and features provided by one or more embodiments of the invention will become more fully understood from the following description taken in conjunction with the accompanying drawings which are given by way of illustration only, and thus are not intended as a definition of the limits of the invention. In the drawings.

DETAILED DESCRIPTION

The following is a description of embodiments of the invention with reference to the drawings. However, the scope of the invention is not limited to the disclosed embodiments.

First Embodiment

Appearance of Image Forming Device

Figure 1A:
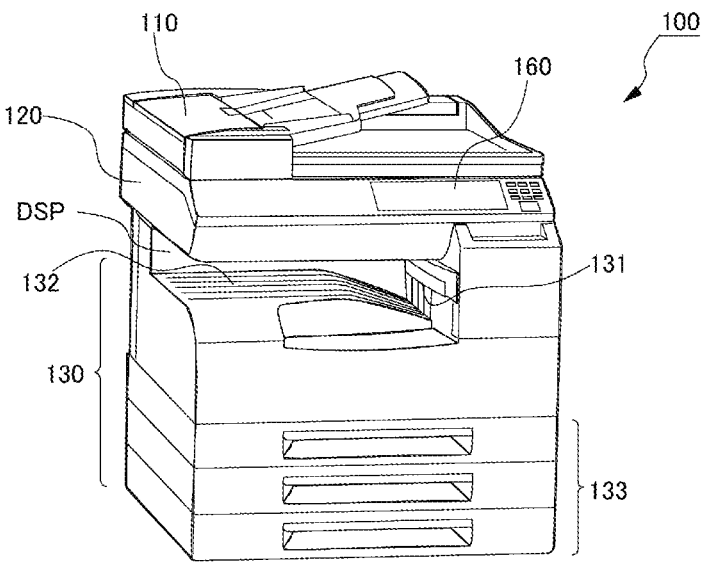
FIG. 1A is a perspective view of an appearance of an image forming device according to a first embodiment of the invention.

FIG. 1A is a perspective view of the appearance of an image forming device according to a first embodiment of the invention. This image forming device is a multi-function peripheral (MFP) 100, which combines functions of a scanner, copier, and printer. The MFP 100 has, on the top surface of its body, an auto document feeder (ADF) 110 to be openable and closable. In an upper portion of the body directly below the ADF 110, the MFP 100 houses a scanner 120, and in a lower portion of the body, it includes a printer 130 with a lower portion to which paper cassettes 133 are attached to be able to slide out like drawers. The MFP 100 is of an in-body paper ejection type; there is a gap DSP between the scanner 120 and the printer 130, in which the MFP 100 has an ejection tray 132, and next to it, an ejection slot 131 from which the MFP 100 ejects sheets to the ejection tray 132. On a front surface of the body located next to the gap DSP, the MFP 100 has an operation panel 160. The operation panel 160 includes a touch panel embedded in its front surface and surrounded by a variety of mechanical push buttons.

Internal Configuration of Printer

Figure 1B:
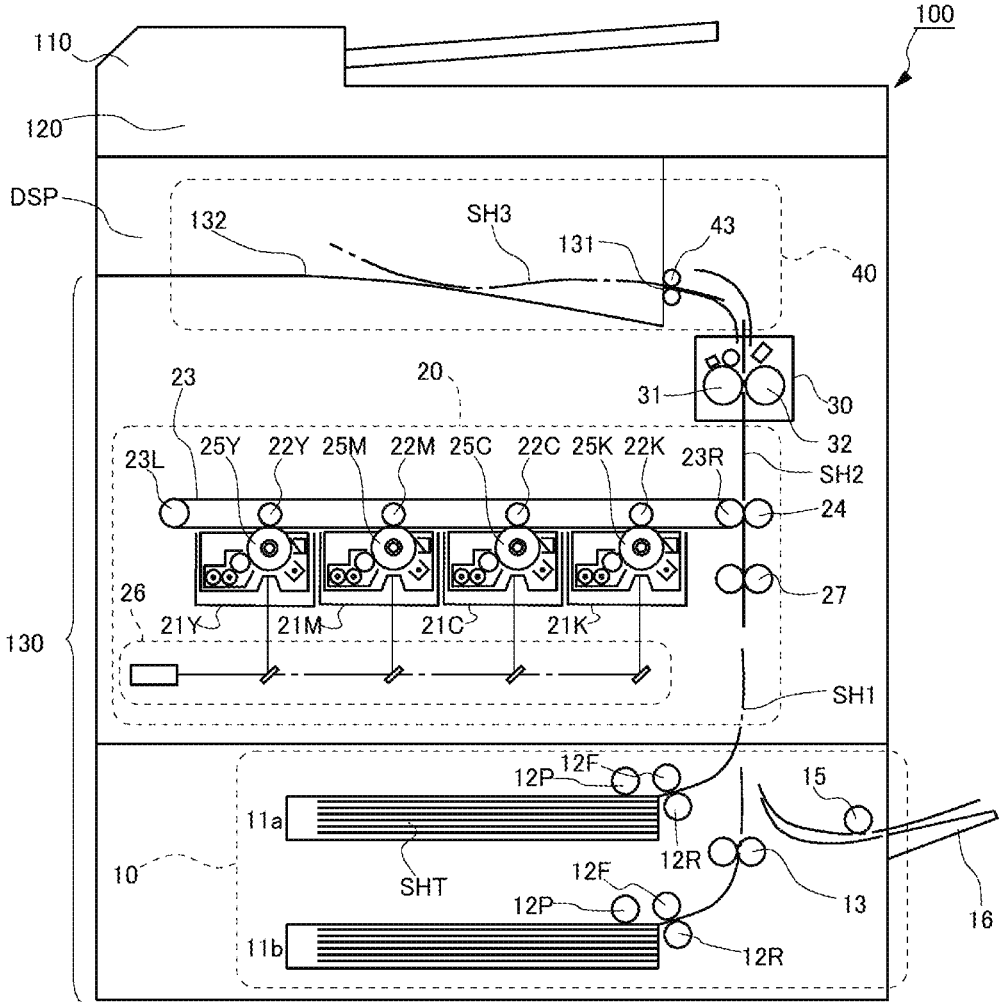
FIG. 1B is a front view of a printer included in the image forming device schematically showing its internal configuration.

FIG. 1B is a front view of the printer 130 schematically showing its internal configuration. FIG. 1B represents elements of the printer 130 as if they can be seen through the front face of the body. The printer 130, which is an electrophotographic color printer, includes a feeder section 10, an imaging section 20, a fuser section 30, and an ejecting section 40, which cooperate with each other to form an image on a sheet based on image data, while conveying the sheet in the body of the MFP 100.

The feeder section 10, which is mechanisms of a sheet feeder installed in the MFP 100, uses conveyance rollers 12P, 12F, 12R, 13, 15 to separate each sheet from a stack of sheets SHT stored in a paper cassette 11*a* or 11*b*, or on a manual feed tray 16 to the imaging section 20. The paper cassettes 11*a*, 11*b* are of a so-called universal type, which can store a variety of sheets therein. Materials of the sheets include paper or resin. Paper types, i.e. types of the sheets include plain, high-quality, color-copier, or coated. Both longitudinal and transverse sizes of the sheets are continuously changeable; sizes of the sheets include business cards, bookmarks, tickets, postcards, envelopes, and photographs (L size), as well as the standard sizes of JIS, e.g. series from A3 to A7 and from B4 to B7. The sheets can be stored in either short- or long-edge-feed orientation.

The imaging section 20 forms a toner image on a sheet SH2 conveyed from the feeder section 10. Concretely, the imaging section 20 first makes four imaging units 21Y, 21M, 21C, 21K charge surfaces of their respective photoreceptor drums 25Y, 25M, 25C, 25K, and expose the surfaces to laser lights from an exposure unit 26 in patterns based on image data. On the surfaces, thus electrostatic latent images are formed. From the electrostatic latent images, the imaging units 21Y-21K next develop toner images of their respective colors, i.e. yellow (Y), magenta (M), cyan (C), and black (K). The imaging units 21Y-21K then transfer the resultant four one-colored toner images in order from the surfaces of the photoreceptor drums 25Y-25K onto the same position on a surface of an intermediate transfer belt 23 by electric fields between primary transfer rollers 22Y, 22M, 22C, 22K and the photoreceptor drums 25Y-25K, thus forming a single multi-colored toner image on the position. When this multi-colored toner image passes through the nip between a driving pulley 23R of the intermediate transfer belt 23 and a secondary transfer roller 24, the imaging section 20 transfers the toner image onto a surface of the sheet SH2 passing through the nip at the same time, by an electric field between the driving pulley 23R and the secondary transfer roller 24. After that, the imaging section 20 separates the sheet SH2 from the secondary transfer roller 24, and sends it to the fuser section 30.

The fuser section 30 thermally fixes a toner image to the sheet SH2 conveyed from the imaging section 20. Concretely, when the sheet SH2 passes through the nip between a fusing roller 31 and a pressure roller 32, the fusing roller 31 applies heat from its built-in heater to the surface of the sheet SH2, and the pressure roller 32 applies pressure to the heated surface of the sheet SH2, pressing the sheet SH2 against the fusing roller 31. The heat from the fusing roller 31 and the pressure from the pressure roller 32 fuse the toner image onto the surface of the sheet SH2. Then, the fuser section 30 conveys the sheet SH2 from its top portion.

The ejecting section 40 uses an ejecting roller 43 to eject the sheet SH3, which is conveyed from the fuser section 30, from the ejection slot 131 onto the ejection tray 132.

Structure of Paper Cassette

Figure 2A:
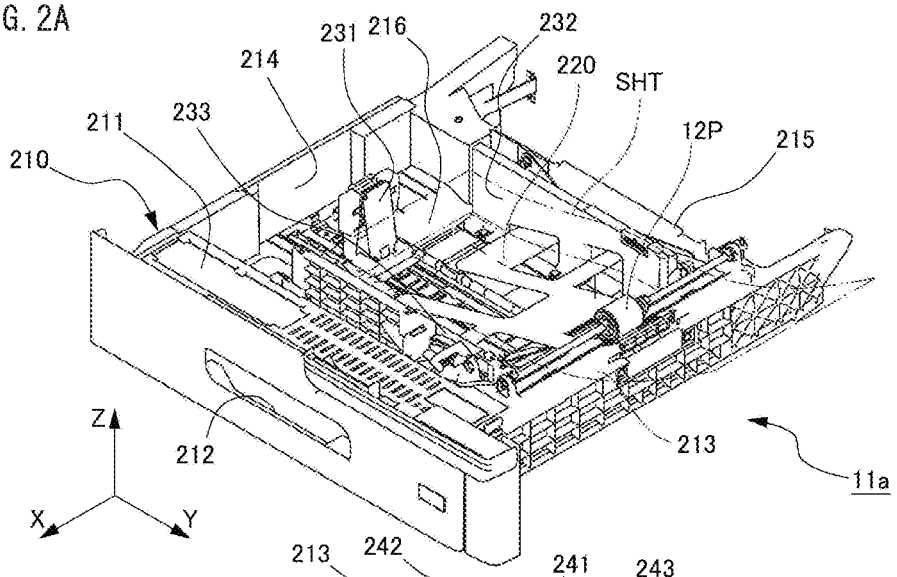
FIG. 2A is a perspective view of an appearance of a paper cassette shown in FIG. 1A and FIG. 1B.

FIG. 2A is a perspective view of the appearance of the paper cassette 11*a*. The paper cassette 11*a* is a member attached to the housing of the printer 130 to be able to slide out like drawers with a body 210, a tray 220, and guides 231-233.

The body 210 of the paper cassette 11*a* is a box shaped as a cuboid with no top face. A front face 211 of the body 210, a portion located on the positive side of the X axis in FIG. 2A, is a portion of the front surface of the printer 130 when the paper cassette 11*a* is in the closed position in the housing of the printer 130. The front face 211 of the body 210 has a pull (or handle, knob, or grip) 213. Side faces 213, 214 of the body 210 extend in the direction in which the paper cassette 11*a* slides, the X-axis direction in FIG. 2A. One 213 of the side faces, which is located on the positive side of the Y axis in FIG. 2A, has an upper end facing an inlet of a sheet conveyance path in the printer 130, i.e. the pair of a feed roller 12F and separation roller 12R in FIG. 1B. This upper end of the side face 213 has a pickup roller 12P mounted thereon. The rotation axis of the pickup roller 12P extends in the sliding (X-axis) direction of the paper cassette 11*a*. One end of the rotation axis is rotatably supported by the upper end of the side face 213 of the body 210, and the other end of the rotation axis is rotatably supported by the upper end of a rear face 215 of the body 210, which is located on the negative side of the X axis in FIG. 2A.

The tray 220 of the paper cassette 11*a* is a thin-plate member shaped as a substantial rectangle, i.e. extends on the bottom face 216 of the body 210 within an area from the center in a horizontal (Y-axis) direction, which is perpendicular to the sliding (X-axis) direction of the paper cassette 11*a*, to a portion under the pickup roller 12P. At the center of the bottom face 216, the tray 220 is supported so that it can swing around its edge located at the center. The swing of the tray 220 can change an angle of inclination of the tray 220 relative to the sheet feed (Y-axis) direction. As shown by a dashed-two-dotted line in FIG. 2A, the tray 220 allows a sheaf of sheets SHT to be stacked thereon. By the inclination of the tray 220, the sheaf SHT is stored in the paper cassette 11*a* in a position with an edge nearer to the pickup roller 12P pushed up. The topmost sheet of the sheaf SHT has an edge in the feed direction contact with the pickup roller 12P, and thus, by the rotation of the pickup roller 12P, climbs the inclined tray 220 and enters the inlet of the conveyance path.

The three guides 231-233 of the paper cassette 11*a* frame three sides of the tray 220 on the bottom face 216 of the body 210. The first guide 231 is a pillar on an opposite side of the tray 220 relative to the pickup roller 12P, and supported by the bottom face 216 to be able to manually slide in the feed (Y-axis) direction. The first guide 231 touches an edge of the sheaf SHT of sheets on the tray 220 to position the edge, which is located on a rear side in the feed (Y-axis) direction. The second and third guides 232, 233 are plates of the same shape and size, and disposed on either sides of the tray 220 in the sliding (X-axis) direction of the paper cassette 11*a*. The second and third guides 232, 233 each have a board face that extends from the bottom face 216 of the body 210 in a direction perpendicular to the bottom face, the positive Z direction, and that spreads parallel to the feed (Y-axis) direction. The second and third guides 232, 233 are both supported by the bottom face 216 to be able to manually slide on the tray 220 in the sliding (X-axis) direction, and touch either sides of the sheaf SHT of sheets on the tray 220 to put the sheaf SHT in between and position the sheaf SHT whose sides are perpendicular to the sliding (X-axis) direction.

Mechanism of Lifting Tray in Paper Cassette

Figure 2B:
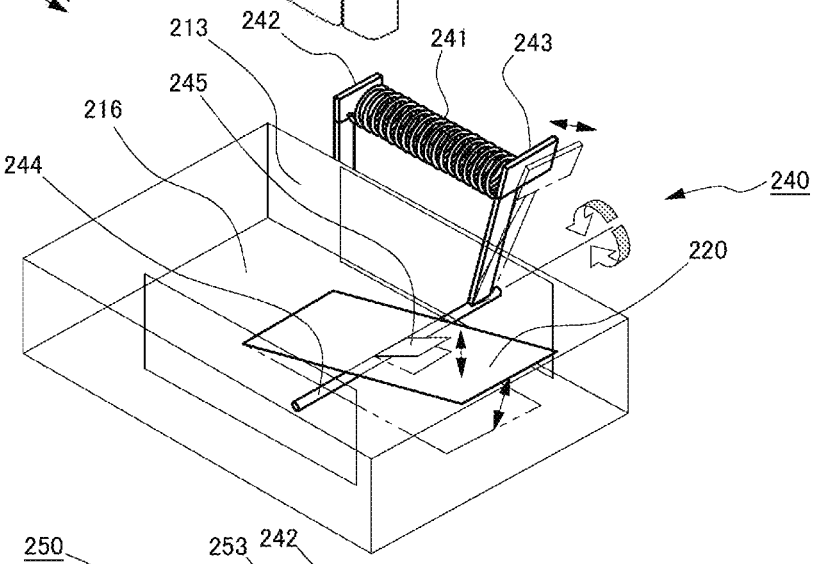
FIG. 2B is a schematic view of a structure of a mechanism of lifting a tray in the paper cassette.

FIG. 2B is a schematic view of the structure of a mechanism 240 of lifting the tray 220 in the paper cassette 11*a*. In FIG. 2B, the body 210 of the paper cassette 11*a* is simplified as a cuboid, and components 241-245 of the lift mechanism 240 are exaggerated. Although not shown in FIG. 2A, these components 241-245 are embedded in the rear and bottom faces 215, 216 of the body 210.

The lift mechanism 240 is a mechanism of changing the inclined angle of the tray 220, and includes an elastic member 241, supporting lever 242, lift lever 243, lift axis 244, and lift plate 245.

The elastic member 241 is, for example, a coil spring, which continuously changes the strength of its restoring force according to a displacement of one end relative to the other end of the spring, a distance in the Y-axis direction between the ends in FIG. 2B. The supporting lever 242 and lift lever 243 are, for example, rods, whose tip ends support either ends of the elastic member 241. The levers 242, 243 are supported to be able to swing around their respective base ends as described below, and by the swing, displace their respective tip ends relative to each other. This deforms the elastic member 241 elastically to change the distance between its ends, e.g. the length of the coil spring, and thus changes the strength of the restoring force.

The lift axis 244 is a rod extending in the sliding (X-axis) direction above the bottom face 216 of the body 210, and its both ends are rotatably supported by the rear and bottom faces 215, 216 of the body 210. At the rear face 215, a first end of the lift axis 244 is connected to the base end of the lift lever 243, and thus the restoring force from the elastic member 241 is received by the tip end of the lift lever 243 to swing the lift lever 243 around its base end and rotate the lift axis 244. At the bottom face 216, a second end of the lift axis 244 supports the lift plate 245, which is a plate of a smaller area than the tray 220, and disposed between the second end of the lift axis 244 and the tray 220 in a manner to be able to swing around the lift axis 244. When the rotating lift axis 244 increases the inclination angle of the lift plate 245, the upper edge of the lift plate 245 pushes up the tray 220, and thus exerts a force onto the sheaf SHT of sheets on the tray 220 in a direction in which a front edge of the sheaf in the feed (X-axis) direction approaches the pickup roller 12P, i.e. the positive Z direction, and presses the topmost sheet of the sheaf SHT against the pickup roller 12P. The lift mechanism 240 thus uses the restoring force of the elastic member 241 to push up the sheaf SHT of sheets with the tray 220, therefore generating pressure for pressing a sheet against the pickup roller 12P, i.e. sheet feed pressure.

Structure of Mechanism of Adjusting Sheet Feed Pressure

Figure 2C:
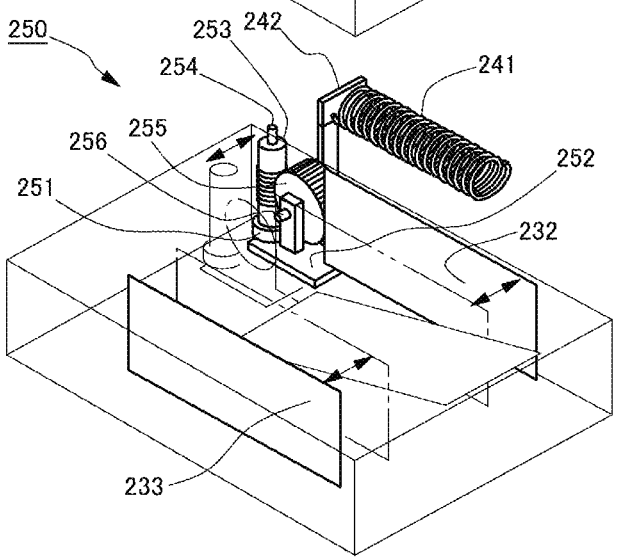
FIG. 2C is a schematic view of a structure of a mechanism of adjusting sheet feed pressure included in the paper cassette.

FIG. 2C is a schematic view of the structure of a mechanism 250 of adjusting sheet feed pressure. In FIG. 2C, the body 210 of the paper cassette 11*a* is simplified as a cuboid, and components 251-256 of the lift mechanism 250 are exaggerated. Although not shown in FIG. 2A, these components 251-256 are embedded in the rear and bottom faces 215, 216 of the body 210.

The adjustor mechanism 250 is a mechanism of adjusting the strength of the restoring force of the elastic member 241 to maintain sheet feed pressure generated by the lift mechanism 240 within a proper range. The adjustor mechanism 250 includes a pinion 251 and an interlocking mechanism 252-256. The pinion 251 is supported by the interlocking mechanism 252-256 on the body 210 of the paper cassette 11*a* to be capable of rotation and translation in the sliding (X-axis) direction of the paper cassette 11*a*. The interlocking mechanism 252-256 is a mechanism of supporting the pinion 251 and linking translation of the pinion 251 to sliding of the second guide 232. The interlocking mechanism includes a movable platform 252, fixed shaft 253, and transmission mechanism 254-256. The platform 252 is a plate fixed to the second guide 232 and movable in the bottom face 216 of the body 210 together with the sliding second guide 232. The shaft 253 is a shaft fixed on the platform 252 and rotatably supporting the pinion 251. The transmission mechanism is a mechanism of converting a torque around the shaft 253 exerted on the pinion 251 into a torque swinging the supporting lever 242, and vice versa. The transmission mechanism includes a worm gear 254, worm wheel 255, and rotation axis 256. The worm gear 254 is coaxially fixed on the pinion 251 to rotate around the shaft 253 together with the rotating pinion 251. The worm wheel 255 is rotatably supported by the platform 252 and engages with the worm gear 254 to rotate. The rotation axis 256 is coaxially fixed to the worm wheel 255 to rotate together with the rotating worm wheel 255. At the rear face 215 of the body 210, the base end of the supporting lever 242 is connected to the rotation axis 256 to be able to slide along the rotation axis 256, which is not shown in FIG. 2C. Caused by rotation of the rotation axis 256, the supporting lever 242 swings to displace its tip end relative to the tip end of the lift lever 243. Conversely, when the supporting lever 242 swings due to the restoring force of the elastic member 241, the rotation axis 256 and the worm wheel 255 rotate, and by engaging with the worm wheel 255, the worm gear 254 rotates, thus exerting a torque around the shaft 253 onto the pinion 251.

Figure 3A:
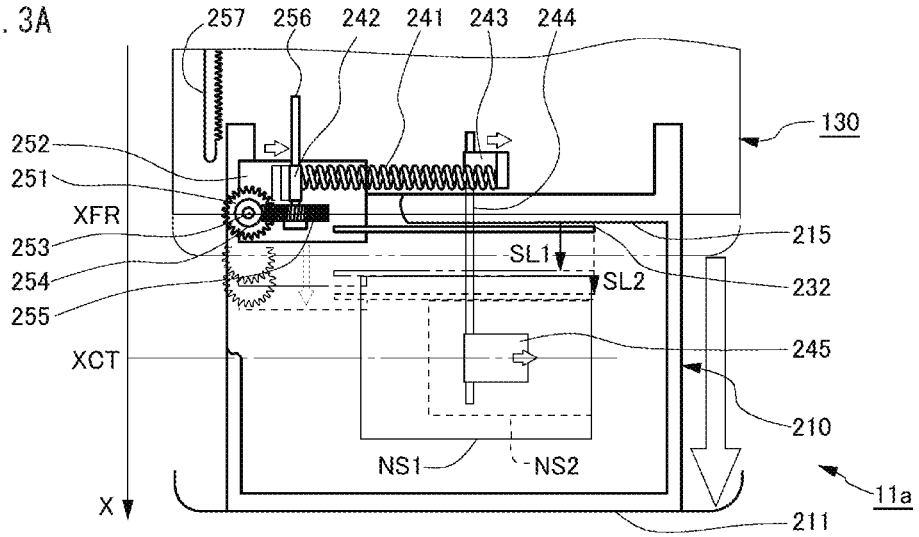
FIG. 3A is a schematic top view of the paper cassette in an opened position out of the housing of the printer shown in FIG. 1A and FIG. 1B.
Figure 3B:
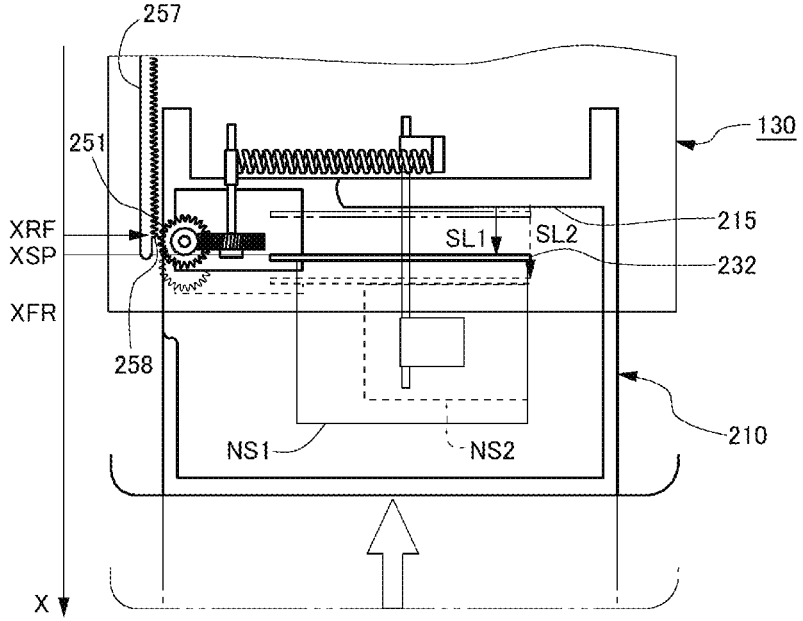
FIG. 3B is a schematic top view of the paper cassette pushed from the opened position out of the housing into the housing.
Figure 3C:
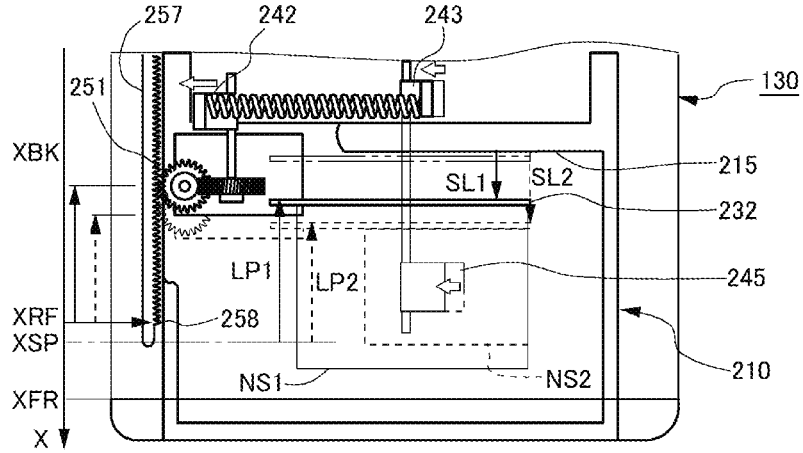
FIG. 3C is a schematic top view of the paper cassette in a closed position inside the housing.

FIG. 3C is a schematic top view of the paper cassette 11*a* in the closed position inside the housing of the printer 130. Of the paper cassette 11*a* in the closed position, the front face 211 of the body 210 is located at the same coordinate X=XFR in the sliding (X-axis) direction of the paper cassette 11*a* as the front face of the printer 130, and the rear face 215 of the body 210 is located at the coordinate X=XBK<XFR inside the housing of the printer 130. In this conditions, the pinion 251 engages with a rack 257, which is a component of the adjustor mechanism 250 and fixed inside the housing of the printer 130 along a rail for the paper cassette 11*a*, a bar supporting the paper cassette 11*a* slidably in its sliding (X-axis) direction. When the paper cassette 11*a* is pulled out of the housing of the printer 130 or pushed into the housing, the paper cassette 11*a* slides along the rail in the sliding (X-axis) direction, and accordingly, the pinion 251 moves in the same direction. Along the trajectory of the pinion 251, teeth of the rack 257 are aligned, and thus the pinion 251 moves with rotating on the teeth.

Action of Mechanism of Adjusting Sheet Feed Pressure

—Overview—

When the paper cassette 11*a* is in the opened position out of the housing of the printer 130, the interlocking mechanism 252-256 links sliding of the second guide 232, which positions sheets, to translation of the pinion 251. Thus, the position of the pinion 251 in the body 210, together with the position of the second guide 232, is adjusted continuously to the size of the sheets. While the paper cassette 11*a* is pushed from the opened position, which is out of the housing of the printer 130, to the closed position, which is in the housing, the interlocking mechanism 252-256 maintains the position of the second guide 232 in the body 210. From the time the second guide 232 reaches a specific point on the trajectory along which the second guide 232 travels together with the pushed-in paper cassette 11*a*, the pinion 251 engages with the rack 257 to rotate. Since the interlocking mechanism 252-256 links the rotation of the pinion 251 to swinging of the supporting lever 241, the torque from the pinion 251 displaces one end of the elastic member 241 relative to the other end. The time the second guide 232 reaches the specific point corresponds continuously to the position of the second guide 232 in the body 210, and thus the distance by which the second guide 232 overruns the specific point at the time the paper cassette 11*a* reaches the closed position inside the housing of the printer 130, i.e. the number of rotations of the pinion 251 corresponds continuously to sizes of sheets. In this manner, the adjustor mechanism 250 adjusts a displacement of the one end relative to the other end of the elastic member 241, i.e. the strength of its restoring force, continuously to the size of the sheets.

—Paper Cassette in Opened Position—

FIG. 3A is a schematic top view of the paper cassette 11*a* in the opened position out of the housing of the printer 130. Of the paper cassette 11*a* in the opened position, the rear face 215 of the body 210, together with the platform 252, is advanced near the coordinate X=XFR of the front face of the printer 130. The advanced paper cassette 11*a* releases the pinion 251 from the teeth of the rack 257, then allowing the pinion 251 to freely rotate around the shaft 253. On the other hand, due to the weight of the tray 220 on the lift plate 245, the lift axis 244 continues to receive a torque in the direction in which the inclination angle of the lift plate 245 is reduced. Accordingly, the entirety of the elastic member 241, supporting lever 242, and lift lever 243 receive a force from the lift axis 244, but not from the pinion 251. As a result, the tip end of the lift lever 243 is displaced until the inclination angle of the lift plate 245 reaches its minimum. In addition, the elastic member 241 elastically deforms to minimize its elastic deformation amount within a range of the position of the tip end of the supporting lever 242 relative to the tip end of the lift lever 243, i.e. minimize the restoring force. The positions of the tip ends of the supporting and lift levers 242, 243 are hereinafter referred to as their respective "initial positions."

Minimization in inclination angle of the lift plate 245 causes the gentlest slope of the tray 220. Assume that a user stores new sheets NS1 or NS2 in the paper cassette 11*a* with the gentlest slope of the tray 220. The user next slides the guides 231-233 to position the sheets NS1 or NS2 at a proper place. The sliding second guide 232 advances the platform 252 to translate the pinion 251 in the forward direction relative to the body 210, i.e. the positive X direction. Since the center position XCT of the sheets NS1 or NS2 in the sliding (X-axis) direction of the second guide 232 is fixed regardless of sizes of the sheets, the sliding second guide 232 is stopped by the sheets, whose length in the sliding (X-axis) direction is larger, at a place nearer to the rear face 215 of the body 210, and accordingly positions the pinion 251 nearer to the rear face 215. In FIG. 3A, the sliding distance of the second guide 232 from the rear face 215 of the body 210 is a smaller value SL1 when the guide positions the larger-sized sheets NS1 than a value SL2 when the guide positions the smaller-sized sheets NS2: SL1<SL2. Therefore, the pinion 251 is placed nearer to the rear face 215 of the body 210 when the larger-sized sheets NS1 are positioned than when the smaller-sized sheets NS2 are positioned.

As above described, the interlocking mechanism 252-256 determines the position of the pinion 251 in the body 210 according to the position of the second guide 232 in the body 210 when the paper cassette 11*a* is in the opened position out of the housing of the printer 130. While the paper cassette 11*a* is pushed into the housing, the interlocking mechanism 252-256 maintains the position of the pinion 251 in the body 210. Concretely, the platform 252 is fixed to the second guide 232, and accordingly, when the paper cassette 11*a* is accelerated into the housing, an inertia force that the platform 252 receives in the forward (positive X) direction relative to the body 210, is converted into a force that the second guide 232 exerts on the sheets NS1 or NS2 in the forward (positive X) direction. In general, the sheets NS1, NS2 form a sheaf, which is heavier than the entirety of the second guide 232, pinion 251, and interlocking mechanism 252-256. Accordingly, against a force from the second guide 232 caused by the acceleration of the paper cassette 11*a*, the sheets NS1, NS2 are tolerable without being deformed and displaced. On the other hand, a braking force that the paper cassette 11*a* receives when stopping inside the housing of the printer 130, is absorbed by a damper mechanism embedded in the rail. This results in a sufficiently weak inertia force that the platform 252 receives in a backward direction relative to the body 210, i.e. the negative X direction, when the paper cassette 11*a* is stopped, and accordingly, against the inertia force, the platform 252 remains at rest relative to the body 210 without translation. Thus, the pinion 251 is maintained at the determined position in the body 210 while the paper cassette 11*a* is pushed into the housing of the printer 130.

—While Paper Cassette is Pushed—

FIG. 3B is a schematic top view of the paper cassette 11*a* pushed from the opened position out of the housing of the printer 130 into the housing. Caused by the backward motion of the paper cassette 11*a* into the housing, the second guide 232 reaches a specific point X=XSP on its trajectory, which is designed in a volume where the second guide 232 can reach at the same time the pinion 251 engages with the leading tooth of the rack 257, i.e. the nearest tooth 258 to the front face of the printer 130. Accordingly, at the same time the second guide 232 reaches the specific point X=XSP, the pinion 251 can be seen as reaching a point X=XRF of engaging with the leading tooth 258 of the rack 257. As sheets in the paper cassette 11*a* have a larger length in the sliding (X-axis) direction, the second guide 232 is placed nearer to the rear face 215 of the body 210, and thus, earlier reaches the specific point X=XSP, i.e. the pinion 251 earlier reaches the point X=XRF of engaging with the leading tooth 258 of the rack 257. As shown in FIG. 3B, the second guide 232 is placed nearer to the rear face 215 of the body 210 when a larger size of sheets NS1 are stored than when a smaller size of sheets NS2 are stored, SL1<SL2, and accordingly the pinion 251 is nearer to the rear face 215. Therefore, the pinion 251 engages with the leading tooth 258 of the rack 257 earlier when the larger size of sheets NS1 are stored than when the smaller size of sheets NS2 are stored.

By engaging with the teeth of the rack 257, the pinion 251 receives a force from the rack 257 in the forward direction relative to the body 210, i.e. the positive X direction. This force is converted by the interlocking mechanism 252-256 into a force that the second guide 232 exerts on the sheets NS1, NS2 in the forward (positive X) direction. Since this force is, in general, too weak to deform and displace a sheaf of the sheets NS1, NS2, the force fails to translate the pinion 251 relative to the body 210. Accordingly, the backward motion of the body 210 into the housing of the printer 130 moves the pinion 251 with rotating on the teeth of the rack 257.

Figure 4:
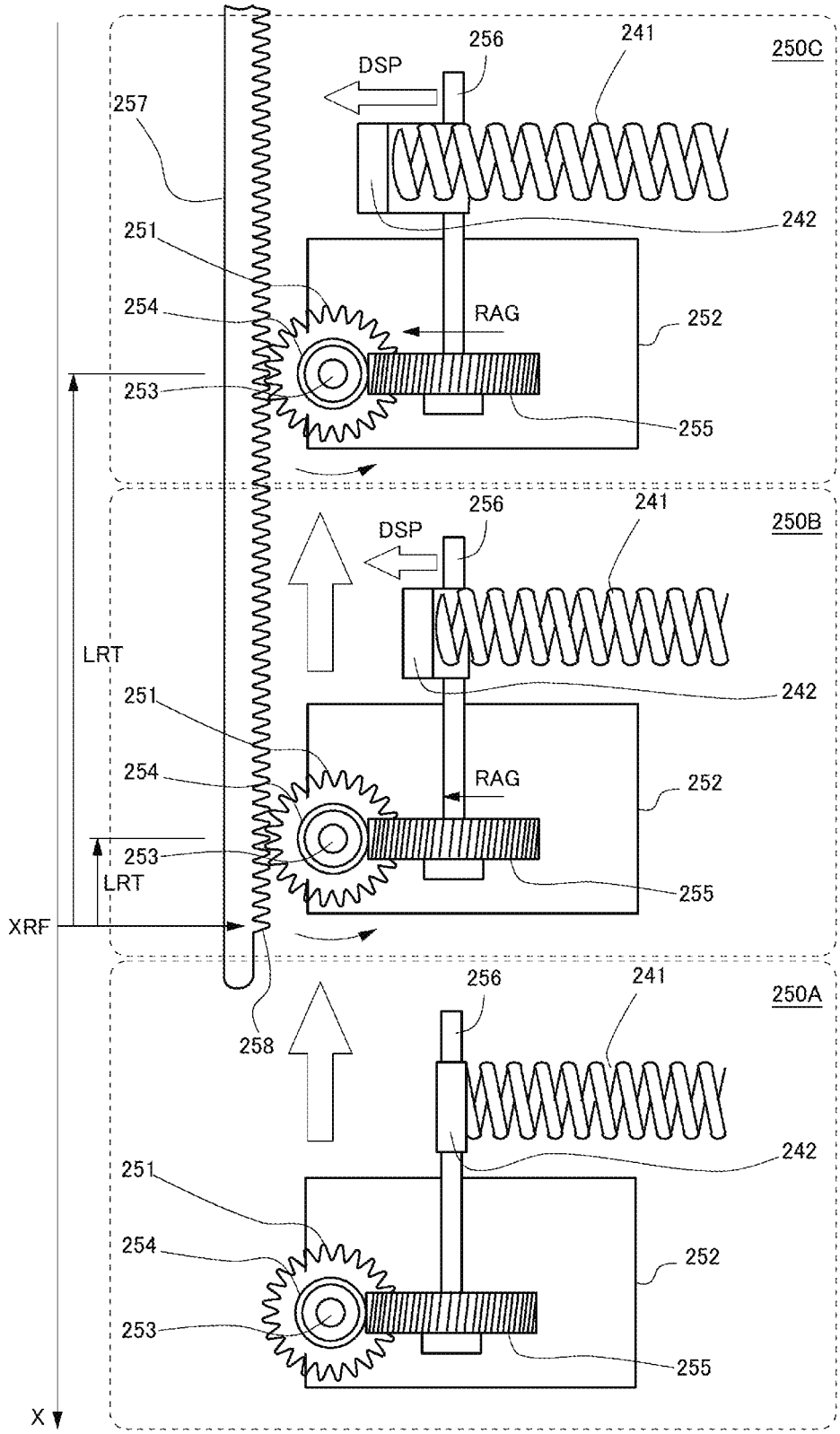
FIG. 4 is a top view schematically showing actions of the adjustor mechanism in conditions with a pinion at different positions relative to teeth of a rack shown in FIG. 3B.

FIG. 4 is a top view schematically showing actions of the adjustor mechanism 250 in first to third conditions with the pinion 251 at different positions relative to the teeth of the rack 257. In the adjustor mechanism 250A in the first condition, the pinion 251 is placed at X>XRF, i.e. in front of the point X=XRF at which the pinion 251 engages with the leading tooth 258 of the rack 257. Since the pinion 251 receives no torque around the shaft 253, the inclined angle of the lift plate 245 remains its minimum and the tip ends of the supporting and lift levers 242, 243 stay at their respective initial positions. In the adjustor mechanism 250B in the second condition, the pinion 251 engages with the leading tooth 258 of the rack 257. Since the pinion 251, regardless of the engaging, stays at the same position relative to the body 210, the backward motion of the body 210 rotates the pinion 251. This rotation follows rotation of the worm gear 254 around the shaft 253, and by engaging with the worm gear 254, the worm wheel 255 rotates itself and the rotation axis 256. Accordingly, the supporting lever 242 swings to displace its tip end from its initial position. In the adjustor mechanism 250C in the third condition, the pinion 251 overruns the leading tooth 258 of the rack 257 by a larger distance LRT than in the adjustor mechanism 250B in the second condition. Since the larger distance LRT results in a larger number of rotations of the pinion 251, the worm wheel 255 rotates by a larger angle RAG and the supporting lever 242 displaces its tip end by a larger amount DSP. Caused by the displacement, the elastic member 241 undergoes elastic deformation more largely, and thus its restoring force is stronger. In this manner, the user's force pushing the paper cassette 11*a* rotates the pinion 251, the torque transmission mechanism 254-256 links the rotation of the pinion 251 to the swinging of the supporting lever 242. By this linkage mechanically converting the force, the rotation number of the pinion 251 corresponds continuously to the displacement DSP of the tip end of the supporting lever 242, i.e. the displacement of the one end relative to the other end of the elastic member 241, and thus continuously to the strength of the restoring force of the elastic member 241.

—Paper Cassette in Closed Position—

As shown in FIG. 3C, when the paper cassette 11*a* returns in the closed position inside the housing of the printer 130, the rear face 215 of the body 210 of the paper cassette 11*a* returns to the original coordinate X=XBK in the sliding (X-axis) direction of the paper cassette 11*a*. As sheets in the paper cassette 11*a* have a larger length in the sliding (X-axis) direction, the second guide 232 is placed nearer to the rear face 215 of the body 210. Accordingly, while the paper cassette 11*a* is pushed from the opened position, which is out of the housing of the printer 130 (cf. FIG. 3A), to the closed position, which is in the housing (cf. FIG. 3C), the second guide 232 overruns the specific point X=XSP by a longer distance. As shown in FIG. 3C, the second guide 232 is placed nearer to the rear face 215 of the body 210 when a larger size of sheets NS1 are stored than when a smaller size of sheets NS2 are stored, SL1<SL2, and accordingly the second guide 232 overruns the specific point X=XSP by a longer distance: LP1=XSP−XBK−SL1>LP2=XSP−XBK−SL2. Since this distance LPx (x=1 or 2) is equal to a distance by which the pinion 251 overruns the leading tooth 258 of the rack 257, the longer the distance LPx, the larger the rotation number of the pinion 251, and the larger the displacement DSP of the tip end of the supporting lever 242. Therefore, the elastic member 241 exerts a stronger restoring force on the tip end of the lift lever 243. In this manner, the adjustor mechanism 250 adjusts the strength of the restoring force of the elastic member 241 according to the distance LPx by which the second guide 232 overruns the specific point X=XSP. The stronger the restoring force, the stronger a force pushing up the tray 220 through the lift axis 244 and lift plate 241. Thus, the sheets stored in the body 210, which have a larger length in the sliding (X-axis) direction of the paper cassette 11*a*, are pushed up by the stronger force. Since difference in strength of the pushing-up force cancels difference in weight per sheet according to the length of the sheets, pressure on the sheets toward the pickup roller 12P, i.e. sheet feed pressure is maintained within a proper range regardless of the size of the sheets.

Merit of First Embodiment

In the sheet feeder according to the first embodiment of the invention, i.e. the feeder section 10 of the MFP 100, the adjustor mechanism 250 includes the pinion 251 and rack 257. When the paper cassette 11*a* is pushed by a user into the housing of the printer 130, the second guide 232 reaches the specific point X=XSP on the trajectory caused by the backward motion of the paper cassette 11*a*, and at the same time, the pinion 251 engages with the leading tooth 258 of the rack 257. Accordingly, while the paper cassette 11*a* is pushed by the user from the opened position, which is out of the housing of the printer 130, to the closed position, which is in the housing, the pinion 251 travels with rotating on the teeth of the rack 257 by the user's force pushing the paper cassette 11*a* from the time the second guide 232 reaches the specific point X=XSP. Then, by the torque of the pinion 251, the transmission mechanism 254-256 swings the supporting lever 242 and elastically deforms the elastic member 241. Thus, the adjustor mechanism 250 mechanically converts the user's force pushing the paper cassette 11*a* into the restoring force of the elastic member 241.

Furthermore, the interlocking mechanism 252-256 links the sliding of the second guide 232 to the translation of the pinion 251. Thus, the position of the second guide 232 in the body 210 of the paper cassette 11*a* corresponds continuously to the position of the pinion 251, and the distance by which the second guide 232 overruns the specific point X=XSP corresponds continuously to the rotation number of the pinion 251. As a result, the distance corresponds continuously to the displacement DSP of the tip end of the supporting lever 242, and thus corresponds continuously to the strength of the restoring force of the elastic member 241. In this manner, the feeder section 10 can associate the strength of the force pushing up sheets continuously with the position of the second guide 232 regardless of the linkage between the mechanism of pushing up sheets and the mechanism of positioning the sheets being the mechanical one operated by hand. Therefore, difference in weight per sheet according to the size of the sheets can be cancelled with high accuracy, and thus the feeder section 10 further improves reliability for its function of maintaining sheet feed pressure within a proper range regardless of the size of the sheets.

Since the pinion 251 is separated from the teeth of the rack 257 when the paper cassette 11*a* is in the opened position out of the housing of the printer 130, the second guide 232 receives no resistive force against its sliding from not only the rack 257 but also the elastic member 241. Accordingly, the user can easily slide the second guide 232 when positioning sheets. In addition, the elastic member 241 receives no external force regardless of displacement of the second guide 232, and thus the tray 220 maintains its gentlest slope. Therefore, the user can easily place sheets into the paper cassette 11*a*, i.e. the feeder section 10 has high operability.

Second Embodiment

A sheet feeder according to a second embodiment of the invention, like the one according to the first embodiment, is installed in the MFP 100 as the feeder section 10. The sheet feeder according to the second embodiment differs from the one according to the first embodiment only in structure of a mechanism of adjusting sheet feed pressure. The difference in the structure will be explained below. Explanation about the other same portions can be found in the description on the first embodiment.

Structure of Mechanism of Adjusting Sheet Feed Pressure

A mechanism of adjusting sheet feed pressure according to the second embodiment, like the one 250 according to the first embodiment in FIG. 2C, is embedded in the rear and bottom faces 215, 216 of the body 210 of the paper cassette 11*a*. The adjustor mechanism according to the second embodiment, in contrast to the one 250 according to the first embodiment, includes a movable reel instead of the pinion 251. The movable reel is a circular-cylinder-shaped drum coaxially fixed at the same position as the pinion 251 in FIG. 2C, i.e. under the worm gear 254, supported by the shaft 253 rotatably therearound, and due to sliding of the platform 252, capable of translation in the sliding (X-axis) direction of the paper cassette 11*a*. Like the rotation of the pinion 251, the rotation of the movable reel is linked through the torque transmission mechanism, i.e. the worm gear 254, worm wheel 255, and rotation axis 256, to the swinging of the supporting lever 242. This linkage converts a torque of the movable reel to the restoring force of the elastic member 241, or vice versa.

Figure 5A:
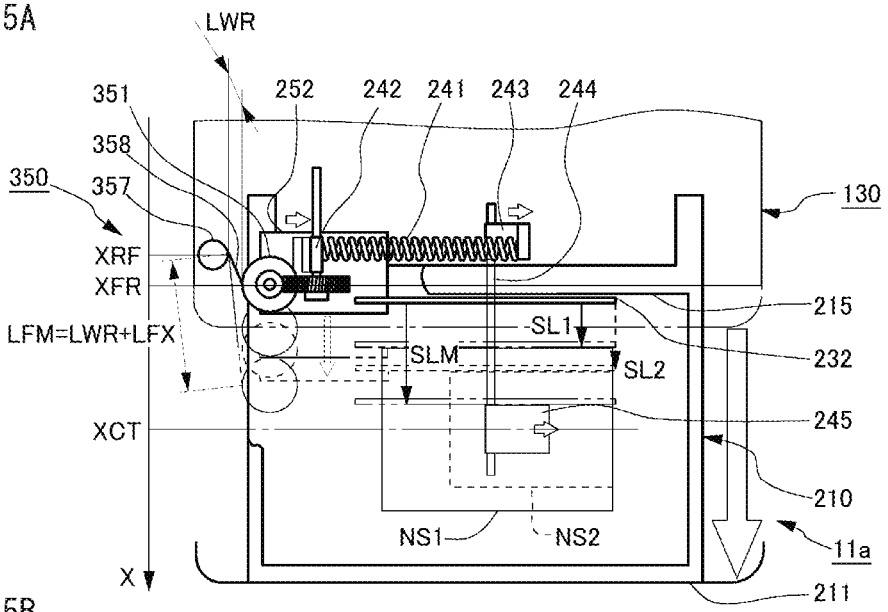
FIG. 5A is a schematic top view of the paper cassette in the opened position out of the housing of the printer according to a second embodiment of the invention.
Figure 5B:
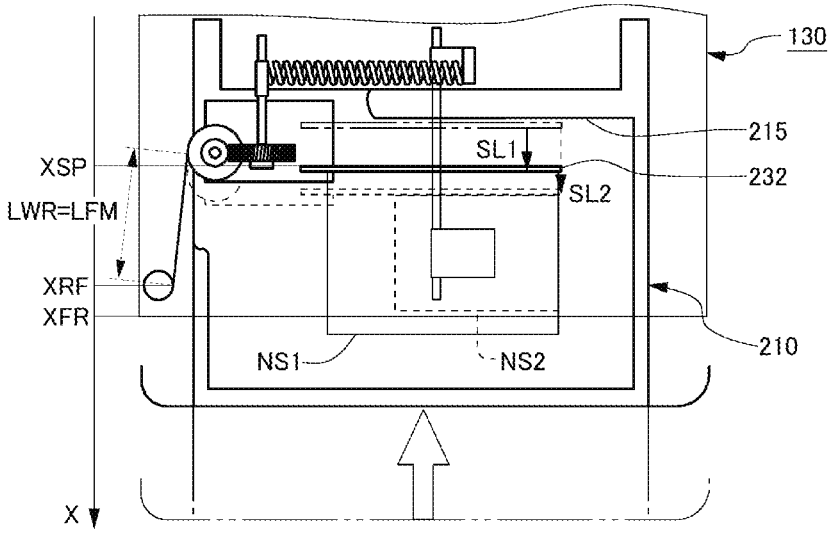
FIG. 5B is a schematic top view of the paper cassette pushed from the opened position out of the housing into the housing.
Figure 5C:
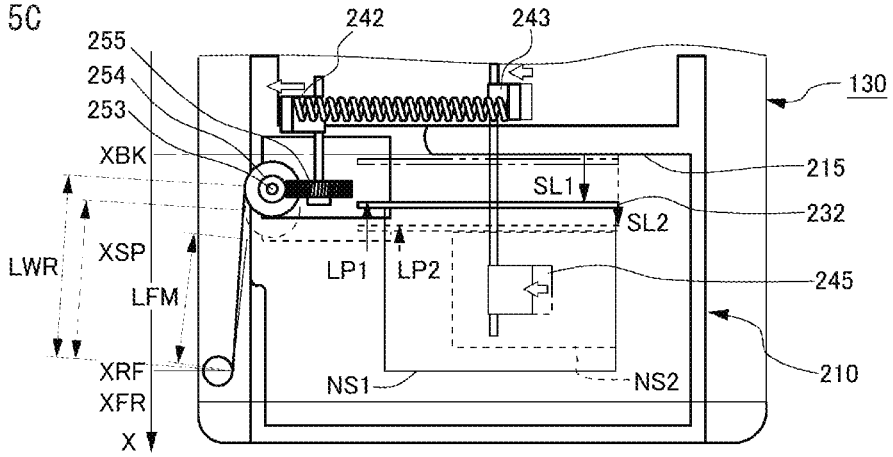
FIG. 5C is a schematic top view of the paper cassette in the closed position inside the housing.

FIG. 5C is a schematic top view of the paper cassette 11*a* in the closed position inside the housing of the printer 130. The adjustor mechanism 350 according to the second embodiment includes a wire 358, which extends from the movable reel 351 to the front face of the housing of the printer 130. The movable reel 351 can reel the wire 358 by a torque converted by the transmission mechanism 254-256 from the restoring force of the elastic member 241. The larger the number of times that the movable reel 351 rotates while unreeling the wire 358, i.e. the longer the unreeled wire 358, the stronger the torque converted by the transmission mechanism 254-256.

This adjustor mechanism 350 further includes a fixed reel 357, which is one of components in place of the rack 257 in FIG. 3C, and fixed inside the housing of the printer 130 to be connected to a first end of the wire 358 extending from the movable reel 351. A point X=XRF at which the fixed reel 357 is fixed is preferably placed in a volume where the front face 211 of the body 210 of the paper cassette 11*a* exists and the trajectory of the movable reel 351 passes. Along the trajectory, the movable reel 351 translates caused by the sliding of the paper cassette 11*a*. The fixed reel 357 includes a drum and a spiral spring (not shown in FIG. 5C). The drum is a circular cylinder supported rotatably around its own center axis, and by the rotation around the center axis, can wind the wire 358 around its circumferential surface on which the first end of the wire 358 is fixed. The spiral spring is coaxially connected to the drum to exert a torque on the drum in the direction to reel the wire 358. The larger the number of times that the drum rotates while unreeling the wire 358, i.e. the longer the unreeled wire 358, the stronger the torque exerted by the spiral spring on the drum.

Action of Mechanism of Adjusting Sheet Feed Pressure

—Overview—

When the paper cassette 11*a* is in the opened position out of the housing of the printer 130, the interlocking mechanism 252-256 links sliding of the second guide 232, which positions sheets, to translation of the movable reel 351. Thus, the position of the movable reel 351 in the body 210, together with the position of the second guide 232, is adjusted continuously to the size of the sheets. While the paper cassette 11*a* is pushed from the opened position, which is out of the housing of the printer 130, to the closed position, which is in the housing, the interlocking mechanism 252-256 maintains the position of the second guide 232 in the body 210. At the time the second guide 232 reaches a specific point on the trajectory along which the second guide 232 travels together with the pushed-in paper cassette 11*a*, the fixed reel 357 unreels a full length of the wire 358. From this time, the movable reel 351 rotates to unreel the wire 358. Since the interlocking mechanism 252-256 links the rotation of the movable reel 351 to the swinging of the supporting lever 241, the torque from the movable reel 351 displaces one end of the elastic member 241 relative to the other end. The time the second guide 232 reaches the specific point corresponds continuously to the position of the second guide 232 in the body 210, and thus the distance by which the second guide 232 overruns the specific point at the time the paper cassette 11*a* reaches the closed position inside the housing of the printer 130, i.e. the length of the wire 358 unreeled from the movable reel 351 corresponds continuously to sizes of sheets. In this manner, the adjustor mechanism 350 adjusts a displacement of the one end relative to the other end of the elastic member 241, i.e. the strength of its restoring force, continuously to the size of the sheets.

—Paper Cassette in Opened Position—

FIG. 5A is a schematic top view of the paper cassette 11*a* in the opened position out of the housing of the printer 130. Of the paper cassette 11*a* in the opened position, the fixed reel 357 includes a predetermined length of the wire 358 reeled from its first end. The predetermined length varies with the position of the second guide 232 in the body 210 of the paper cassette 11*a*, for example, the distance of the second guide 232 from the rear face 215 of the body 210. More concretely, the predetermined length is at least equal to a length LFX of the wire 358 required to be unreeled from either the movable or fixed reel 351 or 357 when the distance of the second guide 232 from the rear face 215 reaches the maximum SLM within a slidable range of the second guide 232, i.e. when the second guide 232 is separated from the rear face 215 to a boundary of the slidable range. In this sense, the predetermined length LFX is hereinafter referred to as a "sliding margin." The sliding margin LFX plus the length LWR of the wire 358 extending between the movable and fixed reels 351, 357 is a constant value independent of the position of the second guide 232. This constant value is at least equal to the length LFM of the wire 358 extending between the movable and fixed reels 351, 357 when the second guide 232 is placed at the boundary of the slidable range: LFX+LWR=LFM. In this sense, the constant value LFM is hereinafter referred to as an "upper sliding margin."

When the paper cassette 11*a* is in the opened position out of the housing of the printer 130, the fixed reel 357 can reel a length of the wire 358 equal to the sliding margin LFX, for example, under the following two conditions a, (3:

α. The maximum torque of the fixed reel 357, i.e. the torque of the fixed reel 357 unreeling a full length of the wire 358 is lower than the minimum torque of the movable reel 351, i.e. the torque converted from the restoring force of the elastic member 241 when the tip ends of the supporting and lift levers 242, 243 stay at their respective initial positions.

β. The movable reel 351 has an upper limit of its reelable length of the wire 358, which is substantially equal, i.e. equal within an acceptable range, to the entire length of the wire 358 except for the upper sliding margin LFM.

Since, due to the condition α, the movable reel 351 has a torque higher than the fixed reel 357, the movable reel 351 first reels the wire 358 when the paper cassette 11*a* is pulled out of the housing of the printer 130. Since the movable reel 351 cannot reel a length of the wire 358 exceeding the upper reelable length specified by the condition β, the fixed reel 357 reels a remaining length of the wire 358 as long as possible after the movable reel 351 reels the upper reelable length of the wire 358. As a result, in the paper cassette 11*a* in the opened position out of the housing of the printer 130, the fixed reel 357 reels the entire length of the wire 358 except for the upper reelable length of the movable reel 351 and the length LWR of the wire 358 extending between both the reels 351, 357, i.e. the length of the wire 358 equal to the sliding margin LFX.

The upper reelable length of the movable reel 351 can be set to a desired value, for example, by using linkage between the rotation of the movable reel 351 and the swinging of the supporting lever 242. This is done concretely as follows. First, the tip end of the supporting lever 242 is set at its initial position under the condition that the movable reel 351 reels the upper reelable length of the wire 358. Next, the swinging range of the supporting lever 242 is limited by a stopper, which is not shown in FIG. 5A, to prevent the tip end of the supporting lever 242 from moving over the initial position.

Due to the condition α, the maximum torque of the fixed reel 357 is lower than the minimum torque of the movable reel 351. Accordingly, the entirety of the elastic member 241, supporting lever 242, and lift lever 243 receive a force from the movable reel 351 not exceeding a force from the lift axis 244. As a result, the supporting and lift levers 242, 243 both maintain their tip ends at the initial positions, and the lift plate 245 maintains its inclination angle at a minimum. Thus, the tray 220 maintains its gentlest slope.

Assume that, in the paper cassette 11*a* with the gentlest slope of the tray 220, a user stores new sheets NS1 or NS2. The user next slides the guides 231-233 to position the sheets NS1 or NS2 at a proper place. The sliding second guide 232 advances the platform 252 to translate the movable reel 351 in the forward (positive X) direction relative to the body 210. Since the movable reel 31 has a torque higher than the fixed reel 357, an elongated length of the wire 358 between both the reels 351, 357 caused by the translation of the movable reel 351 is all unreeled from the fixed reel 357 regardless of the sliding distance of the second guide 232. In other words, the movable reel 351 never rotates during its translation. Therefore, both the levers 242, 243 maintain their tip ends at the initial positions, and the tray 220 maintains its gentlest slope.

Since the center position XCT of the sheets NS1 or NS2 in the sliding (X-axis) direction of the second guide 232 is fixed regardless of sizes of the sheets, the sliding second guide 232 is stopped by the sheets, whose length in the sliding (X-axis) direction is larger, at a place nearer to the rear face 215 of the body 210, and accordingly positions the movable reel 351 nearer to the rear face 215. In FIG. 5A, the sliding distance of the second guide 232 is a smaller value SL1 when the guide positions the larger-sized sheets NS1 than a value SL2 when the guide positions the smaller-sized sheets NS2: SL1<SL2. Therefore, the movable reel 351 is placed nearer to the rear face 215 of the body 210, i.e. the sliding margin LFX is longer, when the larger-sized sheets NS1 are positioned than when the smaller-sized sheets NS2 are positioned.

As above described, the interlocking mechanism 252-256 determines the position of the movable reel 351 in the body 210 according to the position of the second guide 232 in the body 210 when the paper cassette 11*a* is in the opened position out of the housing of the printer 130. While the paper cassette 11*a* is pushed into the housing, the interlocking mechanism 252-256 maintains the position of the movable reel 351 in the body 210. This is similar to the interlocking mechanism 252-256 in the first embodiment maintaining the position of the pinion 251 in the body 210.

—While Paper Cassette is Pushed—

FIG. 5B is a schematic top view of the paper cassette 11*a* pushed from the opened position out of the housing of the printer 130 into the housing. Caused by the backward motion of the paper cassette 11*a* into the housing, the movable reel 351 receives from the wire 358 a force in the forward (positive X) direction relative to the body 210. Since this force is converted by the interlocking mechanism 252-256 into a force that the second guide 232 exerts on the sheets NS1 or NS2 in the forward (positive X) direction, the movable reel 351 remains at rest relative to the body 210 without translation, like the pinion 251. Accordingly, the backward motion of the body 210 into the housing of the printer 130 causes the movable reel 351 to pass by the fixed reel 357 and after that, increase the distance from the fixed reel 357. Since, due to the condition α, the movable reel 351 has a torque higher than the fixed reel 357, an elongated length of the wire 358 caused by the translation of the movable reel 351 is all unreeled from the fixed reel 357. A specific point X=XSP is designed in a volume where the second guide 232 can reach at the same time the fixed reel 357 unreels a full length of the wire 358 equal to the sliding margin LFX from its first end. Accordingly, at the same time the second guide 232 reaches the specific point X=XSP, the fixed reel 357 can be seen as unreeling the full length of the wire 358 equal to the sliding margin LFX to cause the length LWR of the wire 358 extending between both the reels 351, 357 to reach the upper sliding margin LFM: LWR=LFM.

As sheets in the paper cassette 11*a* have a larger length in the sliding (X-axis) direction, the second guide 232 is placed nearer to the rear face 215 of the body 210, and thus, earlier reaches the specific point X=XSP, i.e. the fixed reel 357 earlier unreels the full length of the wire 358 equal to the sliding margin LFX. As shown in FIG. 5B, the second guide 232 is placed nearer to the rear face 215 of the body 210 when a larger size of sheets NS1 are stored than when a smaller size of sheets NS2 are stored, SL1<SL2, and accordingly the movable reel 351 is nearer to the rear face 215. Therefore, the length LWR of the wire 358 extending between the movable and fixed reels 351, 357 reaches the upper sliding margin LFM earlier when the larger size of sheets NS1 are stored than when the smaller size of sheets NS2 are stored.

From the time the fixed reel 357 unreels a full length of the wire 358, its built-in drum cannot rotate, and thus the movable reel 351 receives from the wire 358 a force in the forward (positive X) direction relative to the body 210, which strengthens due to the user's force pushing the paper cassette 11*a* to exceed a reeling force of the movable reel 351. Accordingly, the force received by the movable reel 351 makes it rotate to unreel the wire 358.

Figure 6:
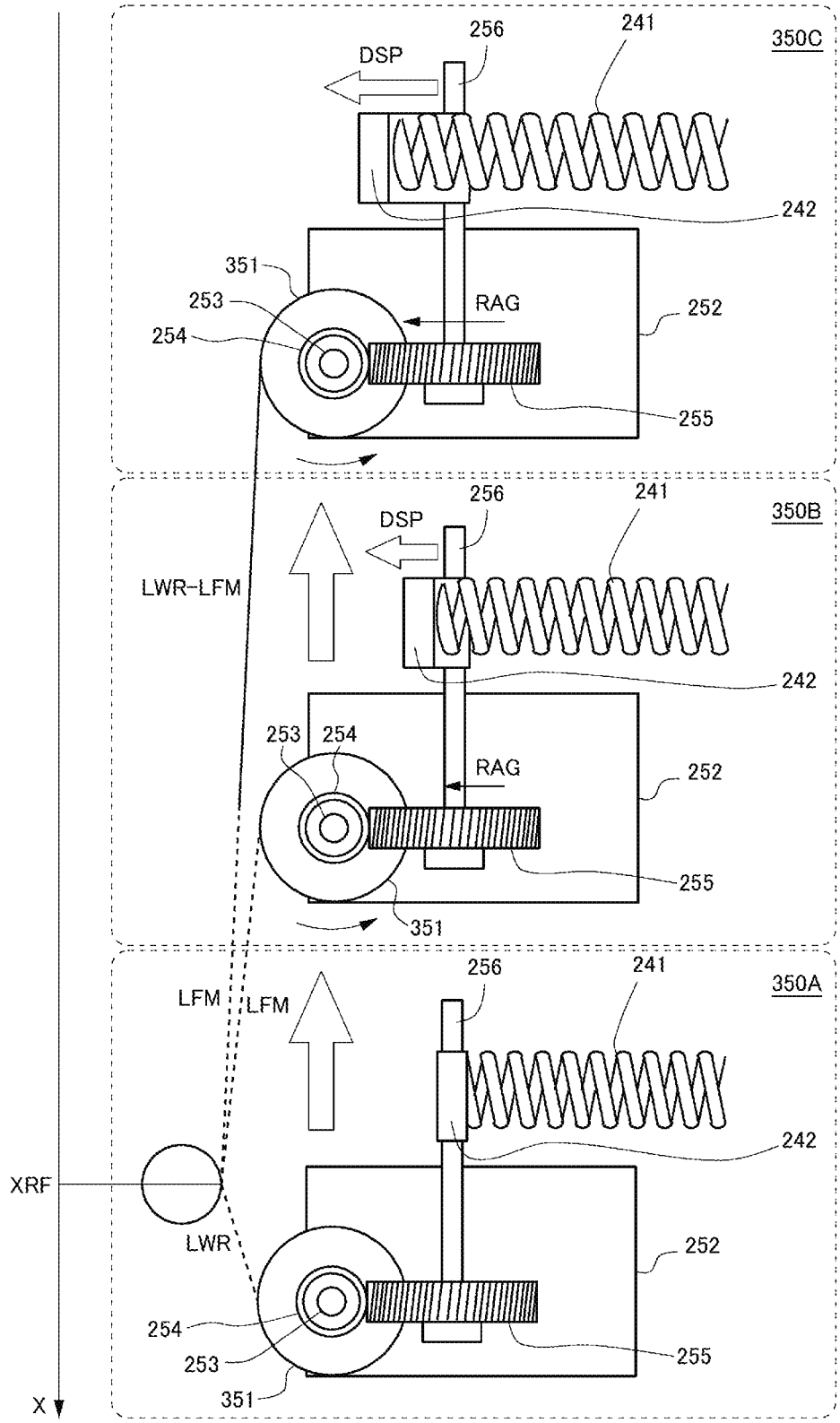
FIG. 6 is a top view schematically showing actions of the adjustor mechanism in conditions with a movable reel at different positions relative to a fixed reel shown in FIG. 5B.

FIG. 6 is a top view schematically showing actions of the adjustor mechanism 350 in first to third conditions with the movable reel 351 at different positions relative to the fixed reel 357. In the adjustor mechanism 350A in the first condition, the movable reel 351 is placed at X>XRF where the length LWR of the wire 358 extending between the movable and fixed reels 351, 357 is smaller than the upper sliding margin LFM. Since the length LWR of the wire 358 is all unreeled from the fixed reel 357 (cf. a thick, broken line in FIG. 6), the movable reel 351 does not receive any torque around the shaft 253. Accordingly, the inclined angle of the lift plate 245 remains its minimum and the tip ends of the supporting and lift levers 242, 243 stay at their respective initial positions. In the adjustor mechanism 350B in the second condition, the length LWR of the wire 358 extending between the movable and fixed reels 351, 357 reaches the upper sliding margin LFM (LWR=LFM), and the fixed reel 357 unreels a full length of the wire 358. Since the movable reel 351 stays at the same position relative to the body 210 regardless of a rapid rise of a force from the wire 358, the backward motion of the body 210 rotates the movable reel 351 to make it unreel the wire 358. This rotation of the movable reel 351 follows rotation of the worm gear 254 around the shaft 253, and by engaging with the worm gear 254, the worm wheel 255 rotates itself and the rotation axis 256. Accordingly, the supporting lever 242 swings to displace its tip end from its initial position. In the adjustor mechanism 350C in the third condition, the length LWR of the wire 358 extending between the movable and fixed reels 351, 357 is larger than in the adjustor mechanism 350B in the second condition. The larger the difference between the length LWR of the wire 358 and the upper sliding margin LFM, i.e. the length of the wire 358 unreeled from the movable reel 351 (cf. a thick, solid line in FIG. 6), LWR-LFM, the larger the rotation number of the movable reel 351, and thus the worm wheel 255 rotates by a larger angle RAG and the supporting lever 242 displaces its tip end by a larger amount DSP. Caused by the displacement, the elastic member 241 undergoes elastic deformation more largely, and thus its restoring force is stronger. In this manner, the user's force pushing the paper cassette 11*a* rotates the movable reel 351, the torque transmission mechanism 254-256 links the rotation of the movable reel 351 to the swinging of the supporting lever 242. By this linkage mechanically converting the force, the rotation number of the movable reel 351 corresponds continuously to the displacement DSP of the tip end of the supporting lever 242, i.e. the displacement of the one end relative to the other end of the elastic member 241, and thus continuously to the strength of the restoring force of the elastic member 241.

—Paper Cassette in Closed Position—

As shown in FIG. 5C, when the paper cassette 11*a* returns in the closed position inside the housing of the printer 130, the rear face 215 of the body 210 of the paper cassette 11*a* returns to the original coordinate X=XBK in the sliding (X-axis) direction of the paper cassette 11*a*. As sheets in the paper cassette 11*a* have a larger length in the sliding (X-axis) direction, the second guide 232 is placed nearer to the rear face 215 of the body 210. Accordingly, while the paper cassette 11*a* is pushed from the opened position, which is out of the housing of the printer 130 (cf. FIG. 5A), to the closed position, which is in the housing (cf. FIG. 5C), the second guide 232 overruns the specific point X=XSP by a longer distance. As shown in FIG. 5C, the second guide 232 is placed nearer to the rear face 215 of the body 210 when a larger size of sheets NS1 are stored than when a smaller size of sheets NS2 are stored, SL1<SL2, and accordingly the second guide 232 overruns the specific point X=XSP by a longer distance: LP1>LP2. The longer the distance LPx (x=1 or 2), the larger the rotation number of the movable reel 351, and the larger the displacement DSP of the tip end of the supporting lever 242. Therefore, the elastic member 241 exerts a stronger restoring force on the tip end of the lift lever 243. In this manner, the adjustor mechanism 350 adjusts the strength of the restoring force of the elastic member 241 according to the distance LPx by which the second guide 232 overruns the specific point X=XSP. The stronger the restoring force, the stronger a force pushing up the tray 220 through the lift axis 244 and lift plate 241. Thus, the sheets stored in the body 210, which have a larger length in the sliding (X-axis) direction of the paper cassette 11*a*, are pushed up by the stronger force. Since difference in strength of the pushing-up force cancels difference in weight per sheet according to the length of the sheets, pressure on the sheets toward the pickup roller 12P, i.e. sheet feed pressure is maintained within a proper range regardless of the size of the sheets.

Merit of Second Embodiment

In the sheet feeder according to the second embodiment of the invention, i.e. the feeder section 10 of the MFP 100, the adjustor mechanism 350 includes the movable reel 351 and the fixed reel 357. When the paper cassette 11*a* is pushed by a user into the housing of the printer 130, the second guide 232 reaches the specific point X=XSP on the trajectory along which the second guide 232 travels caused by the backward motion of the paper cassette 11*a*, and at the same time, the fixed reel 357 unreels a full length of the wire 358. Accordingly, while the paper cassette 11*a* is pushed by the user from the opened position, which is out of the housing of the printer 130, to the closed position, which is in the housing, the wire 358 is unreeled from the movable reel 351 by the user's force pushing the paper cassette 11*a* from the time the second guide 232 reaches the specific point X=XSP. Then, by the torque of the movable reel 351, the transmission mechanism 254-256 swings the supporting lever 242 and elastically deforms the elastic member 241. Thus, the adjustor mechanism 350 mechanically converts the user's force pushing the paper cassette 11*a* into the restoring force of the elastic member 241.

Furthermore, the interlocking mechanism 252-256 links the sliding of the second guide 232 to the translation of the movable reel 351. Thus, the position of the second guide 232 in the body 210 of the paper cassette 11*a* corresponds continuously to the position of the movable reel 351, and the distance by which the second guide 232 overruns the specific point X=XSP corresponds continuously to the rotation number of the movable reel 351. As a result, the distance corresponds continuously to the displacement DSP of the tip end of the supporting lever 242, and thus corresponds continuously to the strength of the restoring force of the elastic member 241. In this manner, the feeder section 10 can easily associate the strength of the force pushing up sheets continuously with the position of the second guide 232 regardless of the linkage between the mechanism of pushing up sheets and the mechanism of positioning the sheets being the mechanical one operated by hand. Therefore, difference in weight per sheet according to the size of the sheets can be cancelled with high accuracy, and thus the feeder section 10 further improves reliability for its function of maintaining sheet feed pressure within a proper range regardless of the size of the sheets.

When the paper cassette 11*a* is in the opened position out of the housing of the printer 130, the fixed reel 357 contains the length of the wire 358 equal to the sliding margin LFX. Since the movable reel 351 has a higher torque than the fixed reel 357, an elongated length of the wire 358 caused by the sliding of the second guide 232 is all unreeled from the fixed reel 357 regardless of the sliding distance SL1 or SL2 of the second guide 232. Accordingly, since the second guide 232 receives only a weak resistive force during its sliding, the user can easily slide the second guide 232 when positioning sheets. In addition, since the movable reel 351 does not rotate, the elastic member 241 receives no external force regardless of displacement of the second guide 232, and thus the tray 220 maintains its gentlest slope. Therefore, the user can easily place sheets into the paper cassette 11*a*, i.e. the feeder section 10 has high operability.

Modification (A) The image forming device 100 shown in FIG. 1A, FIG. 1B is an MFP. The sheet feeder according to the first embodiment of the invention may alternatively be used in a single-function device such as a printer, copier, or fax machine, an ADF mounted on an image reader such as a scanner, or a sheet conveyance device such as a finisher or sorter.

(B) In the paper cassette 11*a* in FIG. 2A to FIG. 2C, the pickup roller 12P sends sheets downstream to the feed roller 12F. Alternatively, the pickup roller may be omitted and a feed roller may send sheets directly from the paper cassette 11*a*.

(C) The elastic member 241 in FIG. 2B, FIG. 2C is a single coil spring. The elastic member may alternatively be of a type with a substantially single body changing the strength of its restoring force continuously accordingly to a displacement of one end relative to the other end of the elastic member: e.g. a single flat or torsion spring, elastomer, or a substantially single spring made of bundled plural springs.

(D) The lift plate 245 in FIG. 2A to FIG. 2C is a part different from the tray 220, and capable of pushing up the tray 220. The lift plate may alternatively be a portion of the tray 220. Instead of the lift plate, the lift axis may exert a torque directly on the tray 220 to change its inclination angle.

(E) The second and third guides 232, 233 may be connected to each other by an interlocking mechanism that links between sliding of both the guides. This mechanism may include, for example, two racks and a single pinion in a portion of the bottom face 216 of the body 210 which is disposed between the second and third guides 232, 233. Each of the racks may be fixed to either the second guide 232 or the third guide 233 so that its tooth row faces the tooth row of the other. The single pinion is placed between the racks and engages with both their tooth rows. The racks and pinion thus engaging with each other exerts on the second guide 232 a force in its sliding direction, and at the same time, exerts on the third guide 233 a force of the same strength but in the opposite direction. As a result, the second guide 232 slides over a distance in a direction, and then the third guide 233 slides over the same distance in the opposite direction, or vice versa. In other words, when positioning sheets, a user only has to slide one of the second and third guides 232, 233 since the other automatically slides. In addition, this interlocking mechanism allows an inertia force received by the platform 252 and second guide 232 to easily cancel an inertia force received by the third guide 233 when the paper cassette 11*a* is accelerated or decelerated relative to the housing of the printer 130. Accordingly, the positions of the pinion 251 or movable reel 351 in the body 210 can be further stabilized while the paper cassette 11*a* is pushed into the housing of the printer 130.

(F) The second guide 232 may be equipped with a claw- or rod-shaped stopper capable of engaging with and separating from the bottom face 216 of the body 210 of the paper cassette 11*a*. When sliding the second guide 232, a user separates the stopper from the bottom face 216, and after bringing the second guide 232 into contact with a side of the sheets NS1 or NS2, makes the stopper engage with the bottom face 216 again. Since the engaging stopper fixes the second guide 232 on the bottom face 216, the platform 252 is also fixed on the bottom face 216. Accordingly, the positions of the pinion 251 or movable reel 351 in the body 210 can be further stabilized while the paper cassette 11*a* is pushed into the housing of the printer 130.

(G) When the paper cassette 11*a* is in the opened condition out of the housing of the printer 130, the sheet feeder according to the first embodiment has the pinion 251 separated from the teeth of the rack 257, and the sheet feeder according to the second embodiment has the fixed reel 357 reeling the length of the wire 358 equal to the sliding margin LFX. In these manner, both the sheet feeders suppress a resistive force against the sliding second guide 232 and prevents the lift plate 245 from increasing its inclination angle when a user positions sheets, thus improving their operability. However, in the case where the resistive force and increasing inclination angle affect the operability of the sheet feeder to only an ignorable extent, the sheet feeder according to the first embodiment may maintain the pinion 251 in a position to engage with the teeth of the rack 257 even when the paper cassette 11*a* is in the opened position out of the housing of the printer 130, and the sheet feeder according to the second embodiment may omit the fixed reel 357 and fix the first end of the wire 358 directly to the housing of the printer 130.

(H) The place X=XRF where the fixed reel 357 is fixed, as shown in FIG. 5A to FIG. 5C, is in the volume where the front face 211 of the body 210 of the paper cassette 11*a* is placed when the paper cassette 11*a* is in the closed position inside the housing of the printer 130, and near the trajectory on which the movable reel 351 translates caused by the sliding of the paper cassette 11*a*. The fixed reel 357 may alternatively be fixed at any place where a wire can extend between the fixed and movable reels without difficulty.

(I) The lift mechanism 240 in FIG. 2A to FIG. 2C, FIG. 3A to FIG. 3C supports the one end of the elastic member 241 with the tip end of the supporting lever 242, and swings the supporting lever 242 around its base end, thus changing the distance between both ends of the elastic member 241. Alternatively, a member supporting the one end of the elastic member 241 may be a reel.

Figure 7:
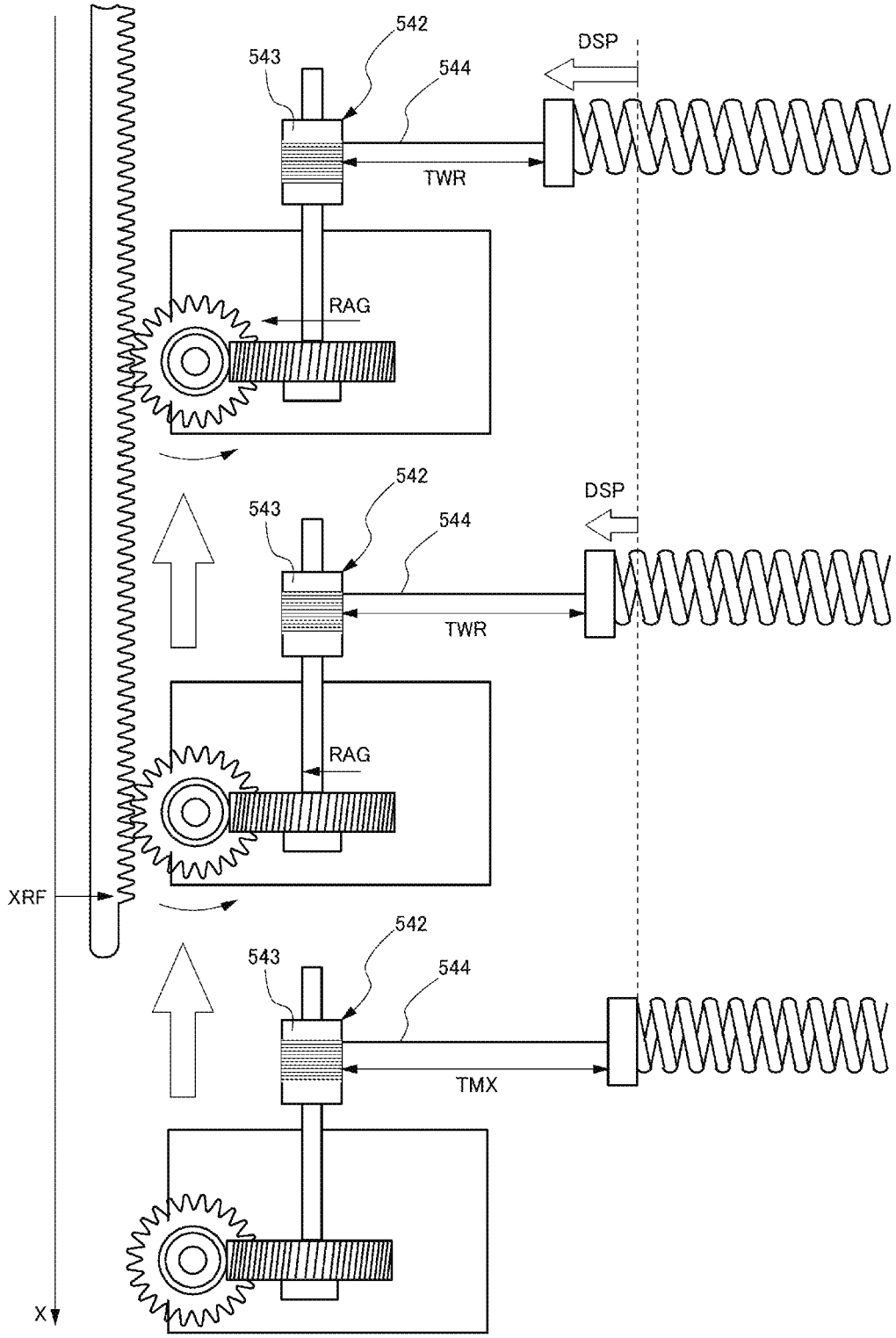
FIG. 7 is a top view schematically showing actions of the adjustor mechanism when the paper cassette is pushed into the housing of the printer; the adjustor mechanism has a reel supporting one end of an elastic member instead of a supporting lever shown in FIG. 1A and FIG. 1B.

FIG. 7 is a top view schematically showing actions of the adjustor mechanism 250 when the paper cassette 11*a* is pushed into the housing of the printer 130; the adjustor mechanism 250 has a reel supporting one end of the elastic member 241, instead of the supporting lever 242. This reel 542 includes a line 543 and drum 544. The line 543 is, for example, a wire with one end fixed to one end of the elastic member 241 and the other end fixed to the drum 544. The drum 544 is connected to the rotation axis 256 of the adjustor mechanism 250 coaxially and slidably along the axis 256. By rotating caused by rotation of the axis 256, the drum 544 reels or unreels the line 543, thus displacing the one end of the elastic member 241 relative to the other end.

The pinion 251 receives no torque around the shaft 253 while traveling in front of the leading tooth 258 of the rack 257, X>XRF. Accordingly, the elastic member 241 maintains its elastic deformation amount at a minimum. Then, the length of the line 543 extending between the elastic member 241 and the drum 544 reaches its maximum TMX.

Caused by the backward motion of the paper cassette 11*a*, the second guide 232 reaches the specific point X=XSP and the pinion 251 engages with the leading tooth 258 of the rack 257. After that, the backward motion of the paper cassette 11*a* rotates the pinion 251, and through the worm gear 254 and worm wheel 255, rotates the rotation axis 256. Accordingly, the drum 544 rotates to reel the line 543. Then, the line 543 extending between the elastic member 241 and the drum 544 decreases its length and pulls the one end of the elastic member 241 to increase the distance between both ends thereof. As the paper cassette 11*a* moves deeper inside the housing of the printer 130, the pinion 251 overruns the leading tooth 258 of the rack 257 by a larger distance LRT. Since the larger distance LRT results in a larger number of rotations of the pinion 251, the worm wheel 255 rotates by a larger angle RAG and the drum 544 reels a longer length of the line 543. As a result, the length TWR of the line 543 extending between the elastic member 241 and the drum 544 is reduced more greatly from its maximum TMX. The elastic member 241 undergoes elastic deformation more largely, and thus its restoring force is stronger. In this manner, the user's force pushing the paper cassette 11*a* rotates the pinion 251, the torque transmission mechanism 254-256 links the rotation of the pinion 251 to the rotation of the drum 544. By this linkage mechanically converting the force, the rotation number of the pinion 251 corresponds continuously to the length of the line 543 reeled by the drum 544, i.e. the displacement of the one end relative to the other end of the elastic member 241, and thus continuously to the strength of the restoring force of the elastic member 241.

SUPPLEMENT

Based on the above-described embodiments, the invention may be further characterized as follows.

The lift mechanism may include a supporter and a lift plate. The supporter supports a first end of the elastic member and movable to displace the first end of the elastic member relative to a second end thereof. The lift plate is shaped as a plate that can swing by the restoring force received from the second end of the elastic member to incline the tray at least partially. The adjuster mechanism may use the force of the user pushing the paper cassette to move the supporter, thus adjusting the position of the supporter according to the distance by which the guide overruns the specific point, and adjusting a displacement of the first end relative to the second end of the elastic member continuously to the overrun distance.

The adjusting mechanism may include a pinion, a rack, and an interlocking mechanism. The pinion is disposed in the body of the paper cassette and is capable of translation on the body in the direction in which the paper cassette slides between the opened and closed positions. The rack is fixed inside the housing so that teeth of the rack are aligned along a trajectory on which the pinion moves when the paper cassette slides between the opened and closed positions. The interlocking mechanism links sliding of the guide to translation of the pinion, and links rotation of the pinion engaging with the rack to motion of the supporter, thus adjusting a displacement of the first end relative to the second end of the elastic member continuously to the number of rotations of the pinion. The interlocking mechanism may determine the position of the pinion in the body of the paper cassette according to the position of the guide in the body when the paper cassette is in the opened position out of the housing, and maintain the position of the pinion in the body while the paper cassette is pushed into the housing. When the paper cassette is pushed into the housing, the interlocking mechanism may convert a force that the pinion receives from the rack in its translational direction, into a force that the guide exerts on the sheet placed on the tray. The direction in which the guide slides may be parallel to the direction in which the paper cassette travels between the opened and closed positions. In this case, the interlocking mechanism may include a movable member, a shaft, and a transmission mechanism. The movable member is fixed on the guide to move together with the guide. The shaft is fixed on the movable member to rotatably support the pinion. The transmission mechanism converts a torque around the shaft exerted on the pinion into a force moving the supporter, and vice versa. The transmission mechanism may include a worm gear and a worm wheel. The worm gear is coaxially fixed on the pinion. The worm wheel engages with the worm gear to rotate. The teeth of the rack may be disposed to release the pinion when the paper cassette is in the opened position out of the housing. The specific point may be designed within a volume where the guide can reach at the same time the pinion engages with the leading tooth of the rack when the paper cassette is pushed into the housing.

The adjuster mechanism may include a wire, a movable reel, and an interlocking mechanism. The wire has a first end fixed to the housing. The movable reel is disposed in the body of the paper cassette, is capable of translation on the body in a direction parallel to the direction in which the paper cassette travels between the opened and closed positions, and is capable of reeling the wire from its second end. The interlocking mechanism links sliding of the guide to translation of the movable reel, and links action of the movable reel letting out the wire to motion of the supporter, thus adjusting a displacement of the first end relative to the second end of the elastic member continuously to the length of the wire out of the movable reel. The adjusting mechanism may determine the position of the movable reel in the body of the paper cassette according to the position of the guide in the body when the paper cassette is in the opened position out of the housing, and maintain the position of the movable reel in the body and lets out the wire from the movable reel while the paper cassette is pushed into the housing. When the paper cassette is pushed into the housing, the interlocking mechanism may convert a force that the movable reel receives from the wire in its translational direction, into a force that the guide exerts on the sheet placed on the tray, and convert a force that lets out the wire from the movable reel, into a force that the supporter exerts on the elastic member. The direction in which the guide slides may be parallel to the direction in which the paper cassette travels between the opened and closed positions. The movable reel may include a drum that can rotate to wind the wire around its outer circumferential surface. The interlocking mechanism may include a movable member, a shaft, and a transmission mechanism. The movable member is fixed on the guide to move together with the guide. The shaft is fixed on the movable member to rotatably support the drum of the movable reel. The transmission mechanism converts a torque around the center axis of the drum exerted on the drum into a force moving the supporter, and vice versa. The transmission mechanism may include a worm gear and a worm wheel. The worm gear is coaxially fixed on the drum of the movable reel. The worm wheel engages with the worm gear to rotate. The sheet feeder may further include a fixed reel. The fixed reel is fixed to the housing and is capable of reeling the wire from its first end. The fixed reel may let out a predetermined length of the wire from its first end, and the movable reel may let out a length of the wire corresponding to the position of the movable reel in the body of the paper cassette, when the paper cassette is in the closed position in the housing. The fixed reel may draw in the predetermined length of the wire from its first end when the paper cassette is in the opened position out of the housing. The specific point may be designed within a volume where the guide can reach at the same time the fixed reel lets out the entirety of the predetermined length of the wire from its first end when the paper cassette is pushed into the housing.

The supporter may include a lever that has a first edge connected to the first end of the elastic member and a second edge fixed to the worm wheel, and that can swing to displace the first edge caused by the rotation of the worm wheel. Also, the supporter may include a line and a drum. The line has a first end fixed to the first end of the elastic member. The drum is coaxially fixed to the worm wheel and capable of rotating to reel the line from its second end caused by the rotation of the worm wheel.

Although one or more embodiments of the present invention have been described and illustrated in detail, the disclosed embodiments are made for the purposes of illustration and example only and not limitation. The scope of the present invention should be interpreted by the terms of the appended claims.

What is claimed is:

1. A sheet feeder comprising:

a housing;

a pickup roller touching a surface of a sheet to feed the sheet out of the housing; and a paper cassette attached to the housing to be able to slide out like drawers, storing the sheet to be fed by the pickup roller, the paper cassette including:

a body with a tray allowing the sheet to be loaded thereon;

a guide slidable on the tray to touch a side of the sheet and align the sheet at a proper position;

a lift mechanism having a substantially single-piece elastic member, and by a restoring force of the elastic member, pushing up at least one portion of the tray on which a portion of the sheet is aligned, to exert a directing force directing the portion of the sheet towards the pickup roller; and an adjuster mechanism that, when the paper cassette is pushed by a user from an opened position, which is out of the housing, to a closed position, which is in the housing, mechanically converts a pushing force of the user pushing the paper cassette to the restoring force of the elastic member from a time the guide reaches a specific point on a trajectory along which the guide travels together with the paper cassette, thus adjusting the strength of the restoring force continuously to a distance by which the guide overruns the specific point, the adjusting the strength of the restoring force thereby adjusting the directing force directing the portion of the sheet towards the pickup roller;

wherein the lift mechanism includes:

a supporting lever supporting a first end of the elastic member and movable to displace the first end of the elastic member relative to a second end thereof, and a lift plate shaped as a plate that can swing by the restoring force received from the second end of the elastic member to incline the tray at least partially, and the adjuster mechanism uses the pushing force of the user pushing the paper cassette to move the supporting lever, thus adjusting the position of the supporting lever according to the overrun distance of the guide, and adjusting a displacement of the first end relative to the second end of the elastic member continuously to the overrun distance;

wherein the adjuster mechanism includes:

a pinion disposed in the body of the paper cassette and capable of translation on the body in the direction in which the paper cassette slides between the opened and closed positions;

a rack fixed inside the housing so that teeth of the rack are aligned along a trajectory on which the pinion moves when the paper cassette slides between the opened and closed positions; and an interlocking mechanism that links sliding of the guide to translation of the pinion, and links rotation of the pinion engaging with the rack to motion of the supporting lever, thus adjusting a displacement of the first end relative to the second end of the elastic member continuously to the number of rotations of the pinion.

2. The sheet feeder according to claim 1, wherein the interlocking mechanism determines the position of the pinion in the body of the paper cassette according to the position of the guide in the body when the paper cassette is in the opened position out of the housing, and maintains the position of the pinion in the body while the paper cassette is pushed into the housing.

3. The sheet feeder according to claim 2, wherein when the paper cassette is pushed into the housing, the interlocking mechanism converts a pinion force that the pinion receives from the rack in its translational direction, into a guide force that the guide exerts on the sheet placed on the tray.

4. The sheet feeder according to claim 3, wherein the direction in which the guide slides is parallel to the direction in which the paper cassette travels between the opened and closed positions, and the interlocking mechanism includes:

a movable platform fixed on the guide to move together with the guide;

a shaft fixed on the movable platform to rotatably support the pinion; and a transmission mechanism that converts a torque around the shaft exerted on the pinion into a supporting lever force moving the supporting lever, and vice versa.

5. The sheet feeder according to claim 4, wherein the transmission mechanism includes:

a worm gear coaxially fixed on the pinion, and a worm wheel engaging with the worm gear to rotate.

6. The sheet feeder according to claim 5, wherein the supporting lever includes a lever that has a first edge connected to the first end of the elastic member and a second edge fixed to the worm wheel, and that can swing to displace the first edge caused by the rotation of the worm wheel.

7. The sheet feeder according to claim 5, wherein the supporting lever includes:

a line with a first end fixed to the first end of the elastic member; and a drum coaxially fixed to the worm wheel and capable of rotating to reel the line from its second end caused by the rotation of the worm wheel.

8. The sheet feeder according to claim 2, wherein the teeth of the rack are disposed to release the pinion when the paper cassette is in the opened position out of the housing; and the specific point is designed within a volume where the guide can reach at the same time the pinion engages with the leading tooth of the rack when the paper cassette is pushed into the housing.

9. A sheet feeder comprising:

a housing;

a pickup roller touching a surface of a sheet to feed the sheet out of the housing; and a paper cassette attached to the housing to be able to slide out like drawers, storing the sheet to be fed by the pickup roller, the paper cassette including:

a body with a tray allowing the sheet to be loaded thereon;

a guide slidable on the tray to touch a side of the sheet and align the sheet at a proper position;

a lift mechanism having a substantially single-piece elastic member, and by a restoring force of the elastic member, pushing up at least one portion of the tray on which a portion of the sheet is aligned, to exert a directing force directing the portion of the sheet towards the pickup roller; and an adjuster mechanism that, when the paper cassette is pushed by a user from an opened position, which is out of the housing, to a closed position, which is in the housing, mechanically converts a pushing force of the user pushing the paper cassette to the restoring force of the elastic member from a time the guide reaches a specific point on a trajectory along which the guide travels together with the paper cassette, thus adjusting the strength of the restoring force continuously to a distance by which the guide overruns the specific point, the adjusting the strength of the restoring force thereby adjusting the force directing the portion of the sheet towards the pickup roller;

wherein the lift mechanism includes:

a supporting lever supporting a first end of the elastic member and movable to displace the first end of the elastic member relative to a second end thereof, and a lift plate shaped as a plate that can swing by the restoring force received from the second end of the elastic member to incline the tray at least partially, and the adjuster mechanism uses the pushing force of the user pushing the paper cassette to move the supporting lever, thus adjusting the position of the supporting lever according to the overrun distance of the guide, and adjusting a displacement of the first end relative to the second end of the elastic member continuously to the overrun distance;

wherein the adjuster mechanism includes:

a wire with a first end fixed to the housing;

a movable reel disposed in the body of the paper cassette, capable of translation on the body in a direction parallel to the direction in which the paper cassette travels between the opened and closed positions, and capable of reeling the wire from its second end; and an interlocking mechanism that links sliding of the guide to translation of the movable reel, and links action of the movable reel letting out the wire to motion of the supporting lever, thus adjusting a displacement of the first end relative to the second end of the elastic member continuously to the length of the wire out of the movable reel.

10. The sheet feeder according to claim 9, wherein the adjuster mechanism determines the position of the movable reel in the body of the paper cassette according to the position of the guide in the body when the paper cassette is in the opened position out of the housing, and maintains the position of the movable reel in the body and lets out the wire from the movable reel while the paper cassette is pushed into the housing.

11. The sheet feeder according to claim 10, wherein, when the paper cassette is pushed into the housing, the interlocking mechanism converts a movable reel force that the movable reel receives from the wire in its translational direction, into a guide force that the guide exerts on the sheet placed on the tray, and converts a letting-out force that lets out the wire from the movable reel, into an exerting force that the supporting lever exerts on the elastic member.

12. The sheet feeder according to claim 11, wherein the direction in which the guide slides is parallel to the direction in which the paper cassette travels between the opened and closed positions, the movable reel includes a drum that can rotate to wind the wire around its outer circumferential surface, and the interlocking mechanism includes:

a movable platform fixed on the guide to move together with the guide;

a shaft fixed on the movable platform to rotatably support the drum of the movable reel; and a transmission mechanism that converts a torque around the center axis of the drum exerted on the drum into a supporting lever force moving the supporting lever, and vice versa.

13. The sheet feeder according to claim 12, wherein the transmission mechanism includes:

a worm gear coaxially fixed on the drum of the movable reel, and a worm wheel engaging with the worm gear to rotate.

14. The sheet feeder according to claim 13, wherein the supporting lever includes a lever that has a first edge connected to the first end of the elastic member and a second edge fixed to the worm wheel, and that can swing to displace the first edge caused by the rotation of the worm wheel.

15. The sheet feeder according to claim 13, wherein the supporting lever includes:

a line with a first end fixed to the first end of the elastic member; and a drum coaxially fixed to the worm wheel and capable of rotating to reel the line from its second end caused by the rotation of the worm wheel.

16. The sheet feeder according to claim 9 further comprising a fixed reel fixed to the housing and capable of reeling the wire from its first end, wherein:

the fixed reel lets out a predetermined length of the wire from its first end, and the movable reel lets out a length of the wire corresponding to the position of the movable reel in the body of the paper cassette, when the paper cassette is in the closed position in the housing;

the fixed reel draws in the predetermined length of the wire from its first end when the paper cassette is in the opened position out of the housing; and the specific point is designed within a volume where the guide can reach at the same time the fixed reel lets out the entirety of the predetermined length of the wire from its first end when the paper cassette is pushed into the housing.

17. A sheet conveyer comprising:

a sheet feeder including:

a housing;

a pickup roller touching a surface of a sheet to feed the sheet out of the housing; and a paper cassette attached to the housing to be able to slide out like drawers, storing the sheet to be fed by the pickup roller; and a conveyer conveying a sheet fed from the sheet feeder, the paper cassette including: a body with a tray allowing the sheet to be loaded thereon;

a guide slidable on the tray to touch a side of the sheet and align the sheet at a proper position;

a lift mechanism having a substantially single-piece elastic member, and by a restoring force of the elastic member, pushing up at least one portion of the tray on which a portion of the sheet is aligned, to exert a directing force directing the portion of the sheet towards the pickup roller; and an adjuster mechanism that, when the paper cassette is pushed by a user from an opened position, which is out of the housing, to a closed position, which is in the housing, mechanically converts a pushing force of the user pushing the paper cassette to the restoring force of the elastic member from a time the guide reaches a specific point on a trajectory along which the guide travels together with the paper cassette, thus adjusting the strength of the restoring force continuously to a distance by which the guide overruns the specific point, the adjusting the strength of the restoring force thereby adjusting the directing force directing the portion of the sheet towards the pickup roller;

wherein the lift mechanism includes:

a supporting lever supporting a first end of the elastic member and movable to displace the first end of the elastic member relative to a second end thereof, and a lift plate shaped as a plate that can swing by the restoring force received from the second end of the elastic member to incline the tray at least partially, and the adjuster mechanism uses the pushing force of the user pushing the paper cassette to move the supporting lever, thus adjusting the position of the supporting lever according to the overrun distance of the guide, and adjusting a displacement of the first end relative to the second end of the elastic member continuously to the overrun distance;

wherein the adjuster mechanism includes:

a pinion disposed in the body of the paper cassette and capable of translation on the body in the direction in which the paper cassette slides between the opened and closed positions;

a rack fixed inside the housing so that teeth of the rack are aligned along a trajectory on which the pinion moves when the paper cassette slides between the opened and closed positions; and an interlocking mechanism that links sliding of the guide to translation of the pinion, and links rotation of the pinion engaging with the rack to motion of the supporting lever, thus adjusting a displacement of the first end relative to the second end of the elastic member continuously to the number of rotations of the pinion.

18. An image forming device comprising:

a sheet conveyer including:

a sheet feeder having:

a housing;

a pickup roller touching a surface of a sheet to feed the sheet out of the housing; and a paper cassette attached to the housing to be able to slide out like drawers, storing the sheet to be fed by the pickup roller;

and a conveyer conveying a sheet fed from the sheet feeder;

and a printer section printing an image on the sheet conveyed by the sheet conveyer, the paper cassette including:

a body with a tray allowing the sheet to be loaded thereon;

a guide slidable on the tray to touch a side of the sheet and align the sheet at a proper position;

a lift mechanism having a substantially single-piece elastic member, and by a restoring force of the elastic member, pushing up at least one portion of the tray on which a portion of the sheet is aligned, to exert a directing force directing the portion of the sheet towards the pickup roller; and an adjuster mechanism that, when the paper cassette is pushed by a user from an opened position, which is out of the housing, to a closed position, which is in the housing, mechanically converts a pushing force of the user pushing the paper cassette to the restoring force of the elastic member from a time the guide reaches a specific point on a trajectory along which the guide travels together with the paper cassette, thus adjusting the strength of the restoring force continuously to a distance by which the guide overruns the specific point, the adjusting the strength of the restoring force thereby adjusting the directing force directing the portion of the sheet towards the pickup roller;

wherein the lift mechanism includes:

a supporting lever supporting a first end of the elastic member and movable to displace the first end of the elastic member relative to a second end thereof, and a lift plate shaped as a plate that can swing by the restoring force received from the second end of the elastic member to incline the tray at least partially, and the adjuster mechanism uses the pushing force of the user pushing the paper cassette to move the supporting lever, thus adjusting the position of the supporting lever according to the overrun distance of the guide, and adjusting a displacement of the first end relative to the second end of the elastic member continuously to the overrun distance;

wherein the adjuster mechanism includes:

a pinion disposed in the body of the paper cassette and capable of translation on the body in the direction in which the paper cassette slides between the opened and closed positions;

a rack fixed inside the housing so that teeth of the rack are aligned along a trajectory on which the pinion moves when the paper cassette slides between the opened and closed positions; and an interlocking mechanism that links sliding of the guide to translation of the pinion, and links rotation of the pinion engaging with the rack to motion of the supporting lever, thus adjusting a displacement of the first end relative to the second end of the elastic member continuously to the number of rotations of the pinion.

19. An image forming device comprising:

a paper cassette that is inserted to the image forming device after being loaded with a sheaf of sheets;

a guide movable in the paper cassette to touch a side of the sheaf and align the sheaf according to various sizes of the sheets;

a pickup roller feeding the sheets in the paper cassette one by one towards an image former;

a lift mechanism pressing the sheaf in the paper cassette against the pickup roller and by a restoring force of an elastic member connected thereto, pushing up at least one portion of the tray on which a portion of the sheet is aligned, to exert a directing force directing the portion of the sheet towards the pickup roller; and an adjuster mechanism adjusting a pressing force exerted by the lift mechanism according to a position of the guide when the paper cassette is inserted to the image forming device, thus adjusting the strength of the restoring force continuously to a distance by which the guide overruns a specific point on a trajectory along which the guide travels together with the paper cassette, the adjusting the strength of the restoring force thereby adjusting the directing force directing the portion of the sheet towards the pickup roller;

wherein the lift mechanism includes:

a supporting lever supporting a first end of the elastic member and movable to displace the first end of the elastic member relative to a second end thereof, and a lift plate shaped as a plate that can swing by the restoring force received from the second end of the elastic member to incline the tray at least partially, and the adjuster mechanism uses the pushing force of the user pushing the paper cassette to move the supporting lever, thus adjusting the position of the supporting lever according to the overrun distance of the guide, and adjusting a displacement of the first end relative to the second end of the elastic member continuously to the overrun distance;

wherein the adjuster mechanism includes:

a pinion disposed in the body of the paper cassette and capable of translation on the body in the direction in which the paper cassette slides between the opened and closed positions;

a rack fixed inside the housing so that teeth of the rack are aligned along a trajectory on which the pinion moves when the paper cassette slides between the opened and closed positions; and an interlocking mechanism that links sliding of the guide to translation of the pinion, and links rotation of the pinion engaging with the rack to motion of the supporting lever, thus adjusting a displacement of the first end relative to the second end of the elastic member continuously to the number of rotations of the pinion.

20. The image forming device according to claim 19, wherein a position where the rack and the pinion are engaged is adjusted according to a position of the guide when the paper cassette is inserted to the image forming device.

21. The image forming device according to claim 20, wherein the pressing force exerted by the lift mechanism is adjusted according to the position where the rack and the pinion are engaged.

* * * * *